US009068287B2

(12) United States Patent
Kato

(10) Patent No.: US 9,068,287 B2
(45) Date of Patent: Jun. 30, 2015

(54) COMPUTER CONTROLLED SEWING MACHINE WITH CUTTING NEEDLES

(71) Applicant: Harumi Kato, Nagoya (JP)

(72) Inventor: Harumi Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 257 days.

(21) Appl. No.: 13/758,205

(22) Filed: Feb. 4, 2013

(65) Prior Publication Data

US 2013/0199430 A1 Aug. 8, 2013

(30) Foreign Application Priority Data

Feb. 6, 2012 (JP) ..... 2012-023272

(51) Int. Cl.

| | |
|---|---|
| ***G06F 19/00*** | (2011.01) |
| ***G06G 7/66*** | (2006.01) |
| ***D05B 37/00*** | (2006.01) |
| ***D05B 81/00*** | (2006.01) |
| ***D05B 19/10*** | (2006.01) |
| ***D05B 37/04*** | (2006.01) |
| ***D05B 19/12*** | (2006.01) |
| ***D05C 5/04*** | (2006.01) |

(52) U.S. Cl.

CPC ..... *D05B 81/00* (2013.01); *D05B 19/10* (2013.01); *D05B 37/04* (2013.01); *D05B 19/12* (2013.01); *D05B 37/00* (2013.01); *D05C 5/04* (2013.01)

(58) Field of Classification Search

CPC ..... D05B 37/04; D05B 19/10; D05B 19/12; D05B 37/00; D05B 81/00; D05C 5/04

USPC ..... 700/134, 136–138; 112/122, 129, 68

See application file for complete search history.

(56) References Cited

U.S. PATENT DOCUMENTS

| | | | |
|---|---|---|---|
| 674,014 | A | 5/1901 | Parkes |
| 1,120,357 | A | 12/1914 | Austin |

(Continued)

FOREIGN PATENT DOCUMENTS

| | | |
|---|---|---|
| JP | A-59-181185 | 10/1984 |
| JP | A-3-193090 | 8/1991 |

(Continued)

OTHER PUBLICATIONS

U.S. Appl. No. 13/623,542, filed Sep. 20, 2012.

(Continued)

*Primary Examiner* — Danny Worrell
*Assistant Examiner* — Katharine Gracz
(74) *Attorney, Agent, or Firm* — Oliff PLC

(57) ABSTRACT

An apparatus includes a processor and a memory configured to store a plurality of cut length data items and a computer-readable instructions that instruct the apparatus to execute steps comprising acquiring pattern data, setting, as a plurality of first needle drop points, a plurality of points on the pattern line at predetermined intervals, setting a cut angle corresponding to each of the plurality of first needle drop points, determining a plurality of second needle drop points among the plurality of first needle drop points, consolidating, based on the plurality of cut length data items, at least some of the plurality of second needle drop points into at least one third needle drop point, identifying a cutting blade corresponding to each of a plurality of fourth needle drop points among the plurality of cutting blades based on the plurality of cut length data items, and generating cut data.

17 Claims, 27 Drawing Sheets

(56) References Cited

U.S. PATENT DOCUMENTS

| | | | |
|---|---|---|---|
| 3,765,350 | A | 10/1973 | Sztari |
| 4,247,998 | A | 2/1981 | Foss |
| 4,411,208 | A | 10/1983 | Nishida et al. |
| 4,422,250 | A | 12/1983 | Golan |
| 4,598,655 | A | 7/1986 | Takenoya |
| 4,762,076 | A | 8/1988 | Wakaizumi |
| 4,774,778 | A | 10/1988 | Williams |
| 4,849,902 | A | 7/1989 | Yokoe et al. |
| 4,943,906 | A | 7/1990 | Tajima et al. |
| 4,998,489 | A | 3/1991 | Hisatake et al. |
| 5,144,899 | A | 9/1992 | Allen |
| 5,151,863 | A | 9/1992 | Komuro et al. |
| 5,191,536 | A | 3/1993 | Komuro et al. |
| 5,222,314 | A | 6/1993 | Inteso |
| 5,261,341 | A | 11/1993 | Asano |
| 5,361,713 | A | 11/1994 | Suzuki |
| 5,377,605 | A | 1/1995 | Frye |
| 5,427,043 | A | 6/1995 | Conley, Jr. et al. |
| 5,555,828 | A | 9/1996 | Rowley |
| 5,555,834 | A | 9/1996 | Bonner |
| 5,632,214 | A | 5/1997 | Conley, Jr. et al. |
| 5,860,374 | A | 1/1999 | Jensen et al. |
| 5,911,182 | A | 6/1999 | Uyama et al. |
| 5,970,895 | A | 10/1999 | Mack |
| 6,000,350 | A | 12/1999 | Koike et al. |
| 6,006,685 | A | 12/1999 | Kastrup et al. |
| 6,095,068 | A | 8/2000 | Hori |
| 6,119,611 | A | 9/2000 | Tomita |
| 6,167,822 | B1 | 1/2001 | Miyasako et al. |
| 6,298,800 | B1 | 10/2001 | Gala |
| 7,168,378 | B2 | 1/2007 | Fukao |
| 7,280,886 | B2 | 10/2007 | Iida et al. |
| 7,302,308 | B2 | 11/2007 | Kato et al. |
| 7,359,760 | B2 | 4/2008 | Kishi et al. |
| 7,542,822 | B2 | 6/2009 | Kawaguchi et al. |
| 7,561,939 | B2 | 7/2009 | Kawabe et al. |
| 7,966,955 | B2 | 6/2011 | Niizeki |
| 8,301,292 | B2 | 10/2012 | Tokura |
| 8,438,984 | B2 | 5/2013 | Hasegawa et al. |
| 2005/0234585 | A1 | 10/2005 | Muto et al. |
| 2006/0167581 | A1 | 7/2006 | Kawaguchi et al. |
| 2007/0225855 | A1 | 9/2007 | Yamada |
| 2008/0216721 | A1 | 9/2008 | Nagai et al. |
| 2009/0188413 | A1 | 7/2009 | Hirata et al. |
| 2009/0188414 | A1 | 7/2009 | Tokura |
| 2010/0050915 | A1 | 3/2010 | Konig et al. |
| 2013/0054000 | A1 * | 2/2013 | Doukakis et al. ..... 700/134 |

FOREIGN PATENT DOCUMENTS

| | | |
|---|---|---|
| JP | A-5-123464 | 5/1993 |
| JP | U-6-4094 | 1/1994 |
| JP | A-9-217261 | 8/1997 |
| JP | A-2002-136784 | 5/2002 |
| WO | WO 98/24962 A1 | 6/1998 |

OTHER PUBLICATIONS

U.S. Appl. No. 13/644,961, filed Oct. 31, 2012.
Sep. 30, 2013 Office Action issued in U.S. Appl. No. 13/664,961.
Sep. 17, 2013 Office Action issued in U.S. Appl. No. 13/623,542.

* cited by examiner

FIG. 4

46

| NEEDLE BAR | CUT DIRECTION | CUT LENGTH |
|---|---|---|
| NEEDLE BAR 71 (CUTTING BLADE 521) | 0° | 1.5mm |
| NEEDLE BAR 72 (CUTTING BLADE 522) | 45° | 1.5mm |
| NEEDLE BAR 73 (CUTTING BLADE 523) | 90° | 1.5mm |
| NEEDLE BAR 74 (CUTTING BLADE 524) | 135° | 1.5mm |
| NEEDLE BAR 75 (CUTTING BLADE 525) | 0° | 3mm |
| NEEDLE BAR 76 (CUTTING BLADE 526) | 45° | 3mm |
| NEEDLE BAR 77 (CUTTING BLADE 527) | 90° | 3mm |
| NEEDLE BAR 78 (CUTTING BLADE 528) | 135° | 3mm |

FIG. 8

46

| NEEDLE BAR | CUT DIRECTION | CUT LENGTH | CUT LENGTH |
|---|---|---|---|
| NEEDLE BAR 71 (CUTTING BLADE 521) | 0° | 1.5mm | L |
| NEEDLE BAR 72 (CUTTING BLADE 522) | 45° | 1.5mm | L |
| NEEDLE BAR 73 (CUTTING BLADE 523) | 90° | 1.5mm | L |
| NEEDLE BAR 74 (CUTTING BLADE 524) | 135° | 1.5mm | L |
| NEEDLE BAR 75 (CUTTING BLADE 525) | 0° | 3mm | 2L |
| NEEDLE BAR 76 (CUTTING BLADE 526) | 45° | 3mm | 2L |
| NEEDLE BAR 77 (CUTTING BLADE 527) | 90° | 3mm | 2L |
| NEEDLE BAR 78 (CUTTING BLADE 528) | 135° | 3mm | 2L |

FIG. 10

47

| CUTTING SEQUENCE NUMBER | NEEDLE DROP POINT COORDINATES | CUT ANGLE | NEEDLE BAR |
|---|---|---|---|
| 1 | Q1(X1, Y1) | – | – |
| 2 | Q2(X2, Y2) | – | – |
| 3 | Q3(X3, Y3) | – | – |
| 4 | Q4(X4, Y4) | – | – |
| 5 | Q5(X5, Y5) | – | – |
| 6 | Q6(X6, Y6) | – | – |
| 8 | Q7(X7, Y7) | – | – |
| 9 | Q8(X8, Y8) | – | – |
| 10 | Q9(X9, Y9) | – | – |
| ⋮ | ⋮ | ⋮ | ⋮ |
| 16 | Q16(X16, Y16) | – | – |
| 17 | Q17(X17, Y17) | – | – |
| 18 | Q18(X18, Y18) | – | – |
| 19 | Q19(X19, Y19) | – | – |
| 20 | Q20(X20, Y20) | – | – |
| 21 | Q21(X21, Y21) | – | – |
| 22 | Q22(X22, Y22) | – | – |
| 23 | Q23(X23, Y23) | – | – |
| 24 | Q24(X24, Y24) | – | – |
| 25 | Q25(X25, Y25) | – | – |
| 26 | Q26(X26, Y26) | – | – |
| 27 | Q27(X27, Y27) | – | – |
| 28 | Q28(X28, Y28) | – | – |
| 29 | Q29(X29, Y29) | – | – |
| ⋮ | ⋮ | ⋮ | ⋮ |
| 46 | Q46(X46, Y46) | – | – |
| 47 | Q47(X47, Y47) | – | – |
| 48 | Q48(X48, Y48) | – | – |
| 49 | Q49(X49, Y49) | – | – |
| 50 | Q50(X50, Y50) | – | – |
| 51 | Q51(X51, Y51) | – | – |
| 52 | Q52(X52, Y52) | – | – |
| 53 | Q53(X53, Y53) | – | – |
| 54 | Q54(X54, Y54) | – | – |
| 55 | Q55(X55, Y55) | – | – |
| 56 | Q56(X56, Y56) | – | – |
| ⋮ | ⋮ | ⋮ | ⋮ |
| 73 | Q73(X73, Y73) | – | – |

FIG. 12

47

| CUTTING SEQUENCE NUMBER | NEEDLE DROP POINT COORDINATES | CUT ANGLE | NEEDLE BAR |
|---|---|---|---|
| 1 | Q1(X1, Y1) | 90°, 0° | – |
| 2 | Q2(X2, Y2) | 90° | – |
| 3 | Q3(X3, Y3) | 90° | – |
| 4 | Q4(X4, Y4) | 90° | – |
| 5 | Q5(X5, Y5) | 90° | – |
| 6 | Q6(X6, Y6) | 90°, 45° | – |
| 7 | Q7(X7, Y7) | 45° | – |
| 8 | Q8(X8, Y8) | 45°, 0° | – |
| 9 | Q9(X9, Y9) | 0° | – |
| ⋮ | ⋮ | ⋮ | ⋮ |
| 16 | Q16(X16, Y16) | 0°, 45° | – |
| 17 | Q17(X17, Y17) | 45° | – |
| 18 | Q18(X18, Y18) | 45° | – |
| 19 | Q19(X19, Y19) | 45° | – |
| 20 | Q20(X20, Y20) | 45° | – |
| 21 | Q21(X21, Y21) | 45° | – |
| 22 | Q22(X22, Y22) | 45° | – |
| 23 | Q23(X23, Y23) | 45° | – |
| 24 | Q24(X24, Y24) | 45° | – |
| 25 | Q25(X25, Y25) | 45° | – |
| 26 | Q26(X26, Y26) | 45° | – |
| 27 | Q27(X27, Y27) | 45° | – |
| 28 | Q28(X28, Y28) | 45° | – |
| 29 | Q29(X29, Y29) | 45°, 135° | – |
| ⋮ | ⋮ | ⋮ | ⋮ |
| 46 | Q46(X46, Y46) | 90°, 45° | – |
| 47 | Q47(X47, Y47) | 45° | – |
| 48 | Q48(X48, Y48) | 45° | – |
| 49 | Q49(X49, Y49) | 45° | – |
| 50 | Q50(X50, Y50) | 45° | – |
| 51 | Q51(X51, Y51) | 45° | – |
| 52 | Q52(X52, Y52) | 45° | – |
| 53 | Q53(X53, Y53) | 45° | – |
| 54 | Q54(X54, Y54) | 45° | – |
| 55 | Q55(X55, Y55) | 45° | – |
| 56 | Q56(X56, Y56) | 45°, 0° | – |
| ⋮ | ⋮ | ⋮ | ⋮ |
| 73 | Q73(X73, Y73) | 0° | – |

FIG. 13

47

| CUTTING SEQUENCE NUMBER | NEEDLE DROP POINT COORDINATES | CUT ANGLE | NEEDLE BAR |
|---|---|---|---|
| 1 | Q1(X1, Y1) | 90°, 0° | – |
| 2 | $Q2'\left(\frac{(X2+X3)}{2}, \frac{(Y2+Y3)}{2}\right)$ | 90° | – |
| 3 | $Q4'\left(\frac{(X4+X5)}{2}, \frac{(Y4+Y5)}{2}\right)$ | 90° | – |
| 4 | Q6(X6, Y6) | 90°, 45° | – |
| 5 | Q7(X7, Y7) | 45° | – |
| 6 | Q8(X8, Y8) | 45°, 0° | – |
| 7 | Q9(X9, Y9) | 0° | – |
| ⋮ | ⋮ | ⋮ | ⋮ |
| 14 | Q16(X16, Y16) | 0°, 45° | – |
| 15 | $Q17'\left(\frac{(X17+X18)}{2}, \frac{(Y17+Y18)}{2}\right)$ | 45° | – |
| 16 | $Q19'\left(\frac{(X19+X20)}{2}, \frac{(Y19+Y20)}{2}\right)$ | 45° | – |
| 17 | $Q21'\left(\frac{(X21+X22)}{2}, \frac{(Y21+Y22)}{2}\right)$ | 45° | – |
| 18 | $Q23'\left(\frac{(X23+X24)}{2}, \frac{(Y23+Y24)}{2}\right)$ | 45° | – |
| 19 | $Q25'\left(\frac{(X25+X26)}{2}, \frac{(Y25+Y26)}{2}\right)$ | 45° | – |
| 20 | $Q27'\left(\frac{(X27+X28)}{2}, \frac{(Y27+Y28)}{2}\right)$ | 45° | – |
| 21 | Q29(X29, Y29) | 45°, 135° | – |
| ⋮ | ⋮ | ⋮ | ⋮ |
| 31 | Q46(X46, Y46) | 90°, 45° | – |
| 32 | $Q47'\left(\frac{(X47+X48)}{2}, \frac{(Y47+Y48)}{2}\right)$ | 45° | – |
| 33 | $Q49'\left(\frac{(X49+X50)}{2}, \frac{(Y49+Y50)}{2}\right)$ | 45° | – |
| 34 | $Q51'\left(\frac{(X51+X52)}{2}, \frac{(Y51+Y52)}{2}\right)$ | 45° | – |
| 35 | $Q53'\left(\frac{(X53+X54)}{2}, \frac{(Y53+Y54)}{2}\right)$ | 45° | – |
| 36 | Q55(X55, Y56) | 45° | – |
| 37 | Q56(X56, Y56) | 45°, 0° | – |
| ⋮ | ⋮ | ⋮ | ⋮ |
| 46 | Q73(X73, Y73) | 0° | – |

FIG. 15

47

| CUTTING SEQUENCE NUMBER | NEEDLE DROP POINT COORDINATES | CUT ANGLE | CUT ANGLE |
|---|---|---|---|
| 1 | Q1(X1, Y1) | 90°, 0° | 73, 71 |
| 2 | $Q2'\left(\frac{(X2+X3)}{2}, \frac{(Y2+Y3)}{2}\right)$ | 90° | 77 |
| 3 | $Q4'\left(\frac{(X4+X5)}{2}, \frac{(Y4+Y5)}{2}\right)$ | 90° | 77 |
| 4 | Q6(X6, Y6) | 90°, 45° | 73, 72 |
| 5 | Q7(X7, Y7) | 45° | 72 |
| 6 | Q8(X8, Y8) | 45°, 0° | 72, 71 |
| 7 | Q9(X9, Y9) | 0° | 71 |
| ⋮ | ⋮ | ⋮ | ⋮ |
| 14 | Q16(X16, Y16) | 0°, 45° | 71, 72 |
| 15 | $Q17'\left(\frac{(X17+X18)}{2}, \frac{(Y17+Y18)}{2}\right)$ | 45° | 76 |
| 16 | $Q19'\left(\frac{(X19+X20)}{2}, \frac{(Y19+Y20)}{2}\right)$ | 45° | 76 |
| 17 | $Q21'\left(\frac{(X21+X22)}{2}, \frac{(Y21+Y22)}{2}\right)$ | 45° | 76 |
| 18 | $Q23'\left(\frac{(X23+X24)}{2}, \frac{(Y23+Y24)}{2}\right)$ | 45° | 76 |
| 19 | $Q25'\left(\frac{(X25+X26)}{2}, \frac{(Y25+Y26)}{2}\right)$ | 45° | 76 |
| 20 | $Q27'\left(\frac{(X27+X28)}{2}, \frac{(Y27+Y28)}{2}\right)$ | 45° | 76 |
| 21 | Q29(X29, Y29) | 45°, 135° | 72, 74 |
| ⋮ | ⋮ | ⋮ | ⋮ |
| 31 | Q46(X46, Y46) | 90°, 45° | 73, 72 |
| 32 | $Q47'\left(\frac{(X47+X48)}{2}, \frac{(Y47+Y48)}{2}\right)$ | 45° | 76 |
| 33 | $Q49'\left(\frac{(X49+X50)}{2}, \frac{(Y49+Y50)}{2}\right)$ | 45° | 76 |
| 34 | $Q51'\left(\frac{(X51+X52)}{2}, \frac{(Y51+Y52)}{2}\right)$ | 45° | 76 |
| 35 | $Q53'\left(\frac{(X53+X54)}{2}, \frac{(Y53+Y54)}{2}\right)$ | 45° | 76 |
| 36 | Q55(X55, Y56) | 45° | 72 |
| 37 | Q56(X56, Y56) | 45°, 0° | 72, 71 |
| ⋮ | ⋮ | ⋮ | ⋮ |
| 46 | Q73(X73, Y73) | 45°, 0° | 71 |

FIG. 16

47

| CUTTING SEQUENCE NUMBER | NEEDLE DROP POINT COORDINATES | CUT ANGLE | NEEDLE BAR |
|---|---|---|---|
| 1 | Q1 (X1, Y1) | 0° | 71 |
| 2 | Q8 (X8, Y8) | 0° | 71 |
| 3 | Q9 (X9, Y9) | 0° | 71 |
| ⋮ | ⋮ | ⋮ | ⋮ |
| 6 | Q16 (X16, Y16) | 0° | 71 |
| 7 | Q56 (X56, Y56) | 0° | 71 |
| 8 | Q73 (X73, Y73) | 0° | 71 |
| ⋮ | ⋮ | ⋮ | ⋮ |
| 17 | Q1 (X1, Y1) | 90° | 73 |
| 18 | Q6 (X6, Y6) | 90° | 73 |
| ⋮ | ⋮ | ⋮ | ⋮ |
| 31 | $Q17'\left(\frac{(X17+X18)}{2}, \frac{(Y17+Y18)}{2}\right)$ | 45° | 76 |
| 32 | $Q19'\left(\frac{(X19+X20)}{2}, \frac{(Y19+Y20)}{2}\right)$ | 45° | 76 |
| 33 | $Q21'\left(\frac{(X21+X22)}{2}, \frac{(Y21+Y22)}{2}\right)$ | 45° | 76 |
| 34 | $Q23'\left(\frac{(X23+X24)}{2}, \frac{(Y23+Y24)}{2}\right)$ | 45° | 76 |
| 35 | $Q25'\left(\frac{(X25+X26)}{2}, \frac{(Y25+Y26)}{2}\right)$ | 45° | 76 |
| 36 | $Q27'\left(\frac{(X27+X28)}{2}, \frac{(Y27+Y28)}{2}\right)$ | 45° | 76 |
| 37 | $Q47'\left(\frac{(X47+X48)}{2}, \frac{(Y47+Y48)}{2}\right)$ | 45° | 76 |
| 38 | $Q49'\left(\frac{(X49+X50)}{2}, \frac{(Y49+Y50)}{2}\right)$ | 45° | 76 |
| 39 | $Q51'\left(\frac{(X51+X52)}{2}, \frac{(Y51+Y52)}{2}\right)$ | 45° | 76 |
| 40 | $Q53'\left(\frac{(X53+X54)}{2}, \frac{(Y53+Y54)}{2}\right)$ | 45° | 76 |
| 41 | $Q2'\left(\frac{(X2+X3)}{2}, \frac{(Y2+Y3)}{2}\right)$ | 90° | 77 |
| 42 | $Q4'\left(\frac{(X4+X5)}{2}, \frac{(Y4+Y5)}{2}\right)$ | 90° | 77 |
| ⋮ | ⋮ | ⋮ | ⋮ |

FIG. 19

48

| NEEDLE BAR | CUT LENGTH |
|---|---|
| NEEDLE BAR 71 (CUTTING BLADE 531) | 1.5mm |
| NEEDLE BAR 72 (CUTTING BLADE 532) | 3mm |
| NEEDLE BAR 73 (CUTTING BLADE 533) | 4.5mm |
| NEEDLE BAR 74 | - |
| NEEDLE BAR 75 | - |
| NEEDLE BAR 76 | - |
| NEEDLE BAR 77 | - |
| NEEDLE BAR 78 | - |

FIG. 21

48

| NEEDLE BAR | CUT LENGTH | CUT LENGTH |
|---|---|---|
| NEEDLE BAR 71 (CUTTING BLADE 531) | 1.5mm | L |
| NEEDLE BAR 72 (CUTTING BLADE 532) | 3mm | 2L |
| NEEDLE BAR 73 (CUTTING BLADE 533) | 4.5mm | 3L |
| NEEDLE BAR 74 | – | – |
| NEEDLE BAR 75 | – | – |
| NEEDLE BAR 76 | – | – |
| NEEDLE BAR 77 | – | – |
| NEEDLE BAR 78 | – | – |

FIG. 22

49

| CUTTING SEQUENCE NUMBER | NEEDLE DROP POINT COORDINATES | CUT ANGLE (ROTATION ANGLE) | NEEDLE BAR |
|---|---|---|---|
| 1 | Q1 (X1, Y1) | – | – |
| 2 | Q2 (X2, Y2) | – | – |
| 3 | Q3 (X3, Y3) | – | – |
| 4 | Q4 (X4, Y4) | – | – |
| 5 | Q5 (X5, Y5) | – | – |
| 6 | Q6 (X6, Y6) | – | – |
| 8 | Q7 (X7, Y7) | – | – |
| 9 | Q8 (X8, Y8) | – | – |
| 10 | Q9 (X9, Y9) | – | – |
| ⋮ | ⋮ | ⋮ | ⋮ |
| 16 | Q16 (X16, Y16) | – | – |
| 17 | Q17 (X17, Y17) | – | – |
| 18 | Q18 (X18, Y18) | – | – |
| 19 | Q19 (X19, Y19) | – | – |
| 20 | Q20 (X20, Y20) | – | – |
| 21 | Q21 (X21, Y21) | – | – |
| 22 | Q22 (X22, Y22) | – | – |
| 23 | Q23 (X23, Y23) | – | – |
| 24 | Q24 (X24, Y24) | – | – |
| 25 | Q25 (X25, Y25) | – | – |
| 26 | Q26 (X26, Y26) | – | – |
| 27 | Q27 (X27, Y27) | – | – |
| 28 | Q28 (X28, Y28) | – | – |
| 29 | Q29 (X29, Y29) | – | – |
| ⋮ | ⋮ | ⋮ | ⋮ |
| 46 | Q46 (X46, Y46) | – | – |
| 47 | Q47 (X47, Y47) | – | – |
| 48 | Q48 (X48, Y48) | – | – |
| 49 | Q49 (X49, Y49) | – | – |
| 50 | Q50 (X50, Y50) | – | – |
| 51 | Q51 (X51, Y51) | – | – |
| 52 | Q52 (X52, Y52) | – | – |
| 53 | Q53 (X53, Y53) | – | – |
| 54 | Q54 (X54, Y54) | – | – |
| 55 | Q55 (X55, Y55) | – | – |
| 56 | Q56 (X56, Y56) | – | – |
| ⋮ | ⋮ | ⋮ | ⋮ |
| 73 | Q73 (X73, Y73) | – | – |

FIG. 23

49

| CUTTING SEQUENCE NUMBER | NEEDLE DROP POINT COORDINATES | CUT ANGLE (ROTATION ANGLE) | NEEDLE BAR |
|---|---|---|---|
| 1 | Q1(X1, Y1) | 90°, 0° | – |
| 2 | Q2(X2, Y2) | 90° | – |
| 3 | Q3(X3, Y3) | 90° | – |
| 4 | Q4(X4, Y4) | 90°, 88° | – |
| 5 | Q5(X5, Y5) | 88°, 75° | – |
| 6 | Q6(X6, Y6) | 75°, 62° | – |
| 8 | Q7(X7, Y7) | 62°, 51° | – |
| 9 | Q8(X8, Y8) | 51°, 22° | – |
| 10 | Q9(X9, Y9) | 22°, 11° | – |
| ⋮ | ⋮ | | ⋮ |
| 16 | Q16(X16, Y16) | 15°, 45° | – |
| 17 | Q17(X17, Y17) | 45° | – |
| 18 | Q18(X18, Y18) | 45° | – |
| 19 | Q19(X19, Y19) | 45° | – |
| 20 | Q20(X20, Y20) | 45° | – |
| 21 | Q21(X21, Y21) | 45° | – |
| 22 | Q22(X22, Y22) | 45° | – |
| 23 | Q23(X23, Y23) | 45° | – |
| 24 | Q24(X24, Y24) | 45° | – |
| 25 | Q25(X25, Y25) | 45° | – |
| 26 | Q26(X26, Y26) | 45° | – |
| 27 | Q27(X27, Y27) | 45° | – |
| 28 | Q28(X28, Y28) | 45° | – |
| 29 | Q29(X29, Y29) | 45°, 135° | – |
| ⋮ | ⋮ | ⋮ | ⋮ |
| 46 | Q46(X46, Y46) | 90°, 45° | – |
| 47 | Q47(X47, Y47) | 45° | – |
| 48 | Q48(X48, Y48) | 45° | – |
| 49 | Q49(X49, Y49) | 45° | – |
| 50 | Q50(X50, Y50) | 45° | – |
| 51 | Q51(X51, Y51) | 45° | – |
| 52 | Q52(X52, Y52) | 45° | – |
| 53 | Q53(X53, Y53) | 45° | – |
| 54 | Q54(X54, Y54) | 45° | – |
| 55 | Q55(X55, Y55) | 45° | – |
| 56 | Q56(X56, Y56) | 45°, 0° | – |
| ⋮ | ⋮ | ⋮ | ⋮ |
| 73 | Q73(X73, Y73) | 0° | – |

FIG. 24

| CUTTING SEQUENCE NUMBER | NEEDLE DROP POINT COORDINATES | CUT ANGLE (ROTATION ANGLE) | NEEDLE BAR (49) |
|---|---|---|---|
| 1 | Q1(X1cos90° −Y1sin90° , X1sin90° +Y1cos90° )<br>Q1(X1cos0° −Y1sin0° , X1sin0° +Y1cos0° ) | 90°<br>0° | – |
| 2 | Q2(X2cos90° −Y2sin90° , X2sin90° +Y2cos90° ) | 90° | – |
| ⋮ | ⋮ | ⋮ | ⋮ |
| 17 | Q17(X17cos45° −Y17sin45° , X17sin45° +Y17cos45° ) | 45° | – |
| 18 | Q18(X18cos45° −Y18sin45° , X18sin45° +Y18cos45° ) | 45° | – |
| 19 | Q19(X19cos45° −Y19sin45° , X19sin45° +Y19cos45° ) | 45° | – |
| 20 | Q20(X20cos45° −Y20sin45° , X20sin45° +Y20cos45° ) | 45° | – |
| 21 | Q21(X21cos45° −Y21sin45° , X21sin45° +Y21cos45° ) | 45° | – |
| 22 | Q22(X22cos45° −Y22sin45° , X22sin45° +Y22cos45° ) | 45° | – |
| 23 | Q23(X23cos45° −Y23sin45° , X23sin45° +Y23cos45° ) | 45° | – |
| 24 | Q24(X24cos45° −Y24sin45° , X24sin45° +Y24cos45° ) | 45° | – |
| 25 | Q25(X25cos45° −Y25sin45° , X25sin45° +Y25cos45° ) | 45° | – |
| 26 | Q26(X26cos45° −Y26sin45° , X26sin45° +Y26cos45° ) | 45° | – |
| 27 | Q27(X27cos45° −Y27sin45° , X27sin45° +Y27cos45° ) | 45° | – |
| 28 | Q28(X28cos45° −Y28sin45° , X28sin45° +Y28cos45° ) | 45° | – |
| ⋮ | ⋮ | ⋮ | ⋮ |
| 47 | Q47(X47cos45° −Y47sin45° , X47sin45° +Y47cos45° ) | 45° | – |
| 48 | Q48(X48cos45° −Y48sin45° , X48sin45° +Y48cos45° ) | 45° | – |
| 49 | Q49(X49cos45° −Y49sin45° , X49sin45° +Y49cos45° ) | 45° | – |
| 50 | Q50(X50cos45° −Y50sin45° , X50sin45° +Y50cos45° ) | 45° | – |
| 51 | Q51(X51cos45° −Y51sin45° , X51sin45° +Y51cos45° ) | 45° | – |
| 52 | Q52(X52cos45° −Y52sin45° , X52sin45° +Y52cos45° ) | 45° | – |
| 53 | Q53(X53cos45° −Y53sin45° , X53sin45° +Y53cos45° ) | 45° | – |
| 54 | Q54(X54cos45° −Y54sin45° , X54sin45° +Y54cos45° ) | 45° | – |
| 55 | Q55(X55cos45° −Y55sin45° , X55sin45° +Y55cos45° ) | 45° | – |
| ⋮ | ⋮ | ⋮ | ⋮ |
| 73 | Q73(X73cos45° −Y73sin45° , X73sin45° +Y73cos45° ) | 0° | – |

FIG. 25

49

| CUTTING SEQUENCE NUMBER | NEEDLE DROP POINT COORDINATES | CUT ANGLE (ROTATION ANGLE) | NEEDLE BAR |
|---|---|---|---|
| 1 | Q1(X1cos90° −Y1sin90° , X1sin90° +Y1cos90° )<br>Q1(X1cos0° −Y1sin0° , X1sin0° +Y1cos0° ) | 90°, 0° | – |
| 2 | Q2(X2cos90° −Y2sin90° , X2sin90° +Y2cos90° ) | 90° | – |
| ⋮ | ⋮ | ⋮ | ⋮ |
| 15 | $Q17'\left(\frac{(X17+X19)\cos45° - (Y17+Y19)\sin45°}{2}, \frac{(X17+X19)\sin45° + (Y17+Y19)\cos45°}{2}\right)$ | 45° | – |
| 16 | $Q20'\left(\frac{(X20+X22)\cos45° - (Y20+Y22)\sin45°}{2}, \frac{(X20+X22)\sin45° + (Y20+Y22)\cos45°}{2}\right)$ | 45° | – |
| 17 | $Q23'\left(\frac{(X23+X25)\cos45° - (Y23+Y25)\sin45°}{2}, \frac{(X23+X25)\sin45° + (Y23+Y25)\cos45°}{2}\right)$ | 45° | – |
| 18 | $Q26'\left(\frac{(X26+X28)\cos45° - (Y26+Y28)\sin45°}{2}, \frac{(X26+X28)\sin45° + (Y26+Y28)\cos45°}{2}\right)$ | 45° | – |
| ⋮ | ⋮ | ⋮ | ⋮ |
| 28 | $Q47'\left(\frac{(X47+X49)\cos45° - (Y47+Y49)\sin45°}{2}, \frac{(X47+X49)\sin45° + (Y47+Y49)\cos45°}{2}\right)$ | 45° | – |
| 29 | $Q50'\left(\frac{(X50+X52)\cos45° - (Y50+Y52)\sin45°}{2}, \frac{(X50+X52)\sin45° + (Y50+Y52)\cos45°}{2}\right)$ | 45° | – |
| 30 | $Q53'\left(\frac{(X53+X55)\cos45° - (Y53+Y55)\sin45°}{2}, \frac{(X53+X55)\sin45° + (Y53+Y55)\cos45°}{2}\right)$ | 45° | – |
| ⋮ | ⋮ | ⋮ | ⋮ |
| 37 | Q73(X73cos45° −Y73sin45° , X73sin45° +Y73cos45° ) | 0° | – |

FIG. 27

49

| CUTTING SEQUENCE NUMBER | NEEDLE DROP POINT COORDINATES | CUT ANGLE (ROTATION ANGLE) | NEEDLE BAR |
|---|---|---|---|
| 1 | Q1(X1cos90° −Y1sin90° , X1sin90° +Y1cos90° )<br>Q1(X1cos0° −Y1sin0° , X1sin0° +Y1cos0° ) | 90°, 0° | 71 |
| 2 | Q2(X2cos90° −Y2sin90° , X2sin90° +Y2cos90° ) | 90° | 71 |
| ⋮ | ⋮ | ⋮ | ⋮ |
| 15 | $Q17'\left(\frac{(X17+X19)\cos 45° - (Y17+Y19)\sin 45°}{2}, \frac{(X17+X19)\sin 45° + (Y17+Y19)\cos 45°}{2}\right)$ | 45° | 73 |
| 16 | $Q20'\left(\frac{(X20+X22)\cos 45° - (Y20+Y22)\sin 45°}{2}, \frac{(X20+X22)\sin 45° + (Y20+Y22)\cos 45°}{2}\right)$ | 45° | 73 |
| 17 | $Q23'\left(\frac{(X23+X25)\cos 45° - (Y23+Y25)\sin 45°}{2}, \frac{(X23+X25)\sin 45° + (Y23+Y25)\cos 45°}{2}\right)$ | 45° | 73 |
| 18 | $Q26'\left(\frac{(X26+X28)\cos 45° - (Y26+Y28)\sin 45°}{2}, \frac{(X26+X28)\sin 45° + (Y26+Y28)\cos 45°}{2}\right)$ | 45° | 73 |
| ⋮ | ⋮ | ⋮ | ⋮ |
| 28 | $Q47'\left(\frac{(X47+X49)\cos 45° - (Y47+Y49)\sin 45°}{2}, \frac{(X47+X49)\sin 45° + (Y47+Y49)\cos 45°}{2}\right)$ | 45° | 73 |
| 29 | $Q50'\left(\frac{(X50+X52)\cos 45° - (Y50+Y52)\sin 45°}{2}, \frac{(X50+X52)\sin 45° + (Y50+Y52)\cos 45°}{2}\right)$ | 45° | 73 |
| 30 | $Q53'\left(\frac{(X53+X55)\cos 45° - (Y53+Y55)\sin 45°}{2}, \frac{(X53+X55)\sin 45° + (Y53+Y55)\cos 45°}{2}\right)$ | 45° | 73 |
| ⋮ | ⋮ | ⋮ | ⋮ |
| 37 | Q73(X73cos45° −Y73sin45° , X73sin45° +Y73cos45° ) | 0° | 71 |

COMPUTER CONTROLLED SEWING MACHINE WITH CUTTING NEEDLES

CROSS-REFERENCE TO RELATED APPLICATION

This application claims priority to Japanese Patent Application No. 2012-023272, filed Feb. 6, 2012, the content of which is hereby incorporated herein by reference in its entirety.

BACKGROUND

The present disclosure relates to an apparatus that can generate data that may be used for forming a cut in a work cloth along a line that indicates a shape of a designated pattern, and to a non-transitory computer-readable medium.

A sewing machine is known in which a cutting blade, instead of a sewing needle, can be mounted on the lower end of a needle bar. The cutting blade is provided with a sharp cutting edge at its tip. The sewing machine may cause the cutting blade to move up and down by moving the needle bar up and down in the same manner as when performing sewing. By repeatedly inserting the cutting blade into a work cloth, the sewing machine may form a cut in the work cloth along a line that indicates a shape of a pattern.

A sewing machine is also known in which two cutting blades can be mounted on the lower ends of separate needle bars in a state in which the directions of the cutting edges at the tips are orthogonal to one another. One of the cutting blades may be attached to the needle bar in a state in which the direction of the cutting edge is orthogonal to a direction in which warp threads of the work cloth extend. The other one of the cutting blades may be attached to the needle bar in a state in which the direction of the cutting edge is orthogonal to a direction in which weft threads of the work cloth extend. The sewing machine may move the work cloth in specified directions, and move the cutting blades up and down by driving respective needle bars. The sewing machine may form a cut in the work cloth by sequentially cutting the warp and the weft threads.

SUMMARY

The length of the cut that is formed in the work cloth by the sewing machines described above is equal to the width of the cutting edge of the cutting blade. Therefore, in a case where a cutting blade with a large cutting edge width is used, the length of the cut that is formed in the work cloth is large. Accordingly, in a case where the sewing machine forms a straight-line cut in the work cloth by using a cutting blade with a large cutting edge width, it becomes possible to reduce the number of times that the cutting blade moves up and down. In other words, the time that is required in order to form the cut can be decreased. However, in a case where the sewing machine forms a curved-line cut in the work cloth by using a cutting blade with a large cutting edge width, a precise cut may not be formed along the curved line, depending on the degree of curvature of the curved line. In contrast, in a case where the sewing machine uses a cutting blade with a small cutting edge width, it is possible to form a precise cut along the curved line. However, in a case where the cutting width is small, the number of times that the cutting blade moves up and down becomes greater. Therefore, the time that is required in order to form the cut in the work cloth along the line that indicates the shape of the pattern may increase.

Various embodiments of the broad principles derived herein provide an apparatus that may generate cut data for cutting a curved line precisely, as well as for cutting a straight-line portion in a short time, and also provide a non-transitory computer-readable medium that stores computer-readable instructions that cause an apparatus to generate the cut data.

Various embodiments provide an apparatus that includes a processor and a memory. The memory is configured to store a plurality of cut length data items and computer-readable instructions. The plurality of cut length data items indicate lengths of a plurality of cuts configured to be formed by a plurality of cutting blades. Each of the plurality of cutting blades is configured to be attachable to one of a plurality of needle bars of a sewing machine. The computer-readable instructions instruct the apparatus to execute steps including acquiring pattern data, wherein the pattern data represent a position of a point on a pattern line and the pattern line indicates a shape of a pattern to be cut along the pattern line, setting, as a plurality of first needle drop points, a plurality of points on the pattern line at predetermined intervals, wherein each of the plurality of first needle drop points is a position at which one of the plurality of cutting blades is to be inserted, setting a cut angle corresponding to each of the plurality of first needle drop points, wherein the cut angle is an angle that is determined based on a direction in which the pattern line extends at a position of each of the plurality of first needle drop points, determining a plurality of second needle drop points among the plurality of first needle drop points, wherein the second needle drop points are arranged consecutively along the pattern line, and the cut angles of the plurality of the second needle drop points are same, consolidating, based on the plurality of cut length data items, at least some of a plurality of second needle drop points into at least one third needle drop point, identifying a cutting blade corresponding to each of a plurality of fourth needle drop points among the plurality of cutting blades based on the plurality of cut length data items, wherein the plurality of fourth needle drop points include at least one first needle drop point which is unconsolidated among the plurality of first needle drop points and at least one third needle drop point which is consolidated, and generating cut data for the sewing machine, wherein the cut data are configured to cause the sewing machine to sequentially insert the identified cutting blades at the plurality of fourth needle drop points along the pattern line.

Embodiments also provide a non-transitory computer-readable medium storing computer-readable instructions. The computer-readable instructions instruct an apparatus to execute steps including acquiring pattern data, wherein the pattern data represent a position of a point on a pattern line and the pattern line indicates a shape of a pattern to be cut along the pattern line, setting, as a plurality of first needle drop points, a plurality of points on the pattern line at predetermined intervals, wherein each of the plurality of first needle drop points is a position at which one of a plurality of cutting blades is to be inserted, setting a cut angle corresponding to each of the plurality of first needle drop points, wherein the cut angle is an angle that is determined based on a direction in which the pattern line extends at a position of each of the plurality of first needle drop points, determining a plurality of second needle drop points among the plurality of first needle drop points, wherein the second needle drop points are arranged consecutively along the pattern line, and the cut angles of the plurality of the second needle drop points are same, consolidating, based on a plurality of cut length data items, at least some of a plurality of second needle drop points into at least one third needle drop point, wherein the plurality of cut length data items indicate lengths of a plurality of cuts configured to be formed by the plurality of cutting blades, identifying a cutting blade corresponding to each of a plurality of fourth needle drop points among the plurality of cutting blades based on the plurality of cut length data items, wherein the plurality of fourth needle drop points include at least one first needle drop point which is unconsolidated among the plurality of first needle drop points and at least one third needle drop point which is consolidated, and generating cut data for the sewing machine, wherein the cut data are configured to cause the sewing machine to sequentially insert the identified cutting blades at the plurality of fourth needle drop points along the pattern line.

BRIEF DESCRIPTION OF THE DRAWINGS

Embodiments will be described below in detail with reference to the accompanying drawings in which:

FIG. 4 is an explanatory figure of a cutting blade data table;

FIG. 8 is an explanatory figure of a cutting blade data table in which cut lengths are listed;

FIG. 10 is an explanatory figure of a cut data table;

FIG. 12 is an explanatory figure of a cut data table in which cut angles have been registered;

FIG. 13 is an explanatory figure of a cut data table in which some of needle drop points have been consolidated;

FIG. 15 is an explanatory figure of a cut data table in which needle bars have been registered;

FIG. 16 is an explanatory figure of a rearranged cut data table;

FIG. 19 is an explanatory figure of a cutting blade data table according to the second embodiment;

FIG. 21 is a figure in which cut lengths have been registered in the cutting blade data table that is shown in FIG. 19;

FIG. 22 is an explanatory figure of a cut data table according to the second embodiment;

FIG. 23 is an explanatory figure of a cut data table in which the cut angles have been registered;

FIG. 24 is an explanatory figure of a cut data table in a state in which the needle drop point coordinates have been corrected;

FIG. 25 is an explanatory figure of a cut data table in which some of the needle drop points have been consolidated;

FIG. 27 is an explanatory figure of a cut data table in which data that indicate the needle bars have been registered.

DETAILED DESCRIPTION

Hereinafter, an embodiment will be explained with reference to the drawings. A configuration of a multi-needle sewing machine (hereinafter simply referred to as the sewing machine) 1 according to the present embodiment will be explained with reference to FIGS. 1 to 3. The upper side, the lower side, the lower left side, the upper right side, the upper left side, and the lower right side in FIG. 1 respectively correspond to the upper side, the lower side, the front side, the rear side, the left side, and the right side of the sewing machine 1.

Figure 1:
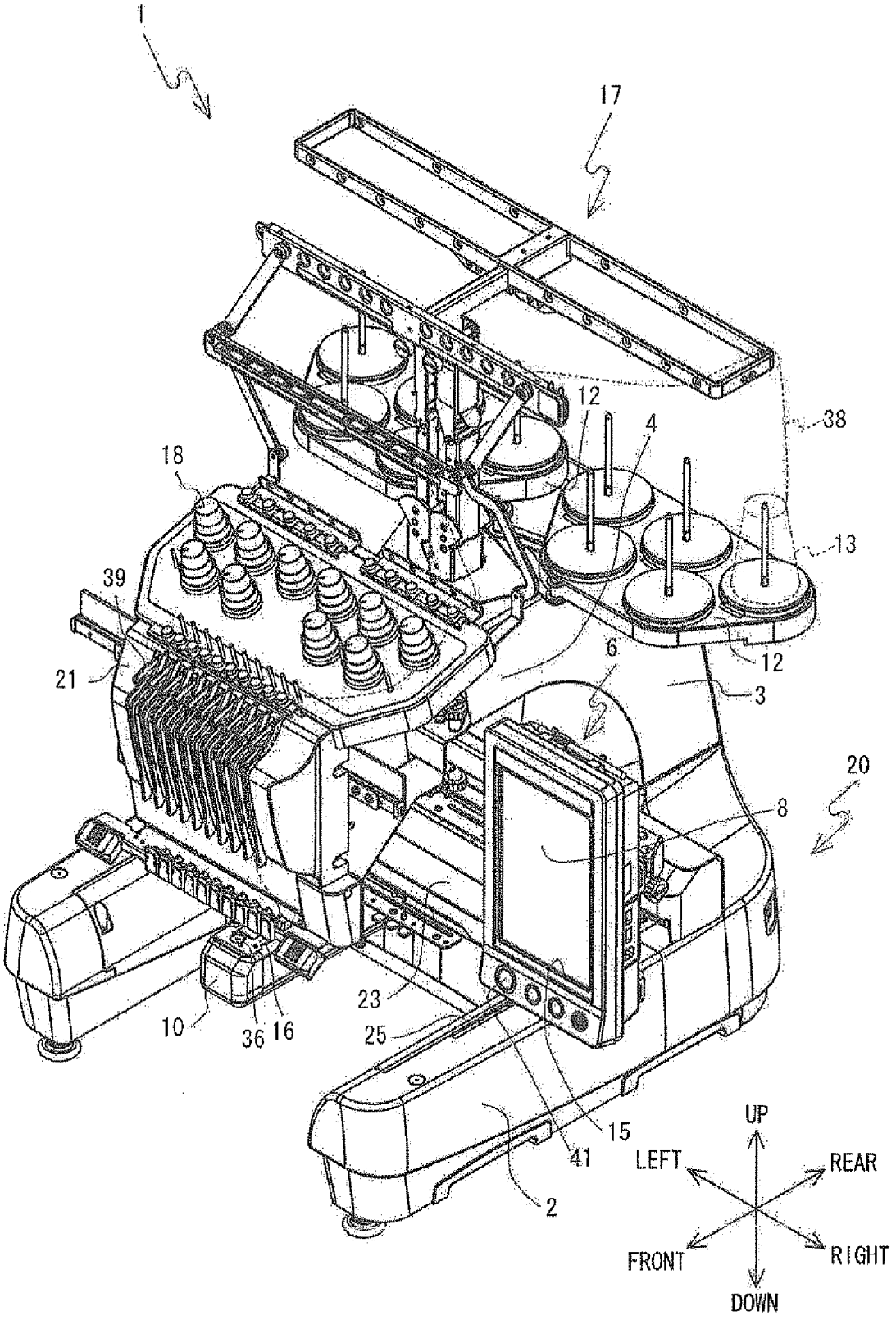
FIG. 1 is a perspective view of a sewing machine.

As shown in FIG. 1, a body 20 of the sewing machine 1 includes a support portion 2, a pillar 3, and an arm 4. The support portion 2 is a base portion that is formed in an inverted U shape in a plan view. A left-right pair of guide slots 25 that extend in the front-rear direction are provided in the top face of the support portion 2. The pillar 3 extends upward from the rear end portion of the support portion 2. The arm 4 extends toward the front from the upper end portion of the pillar 3. A needle bar case 21 is attached to the front end of the arm 4 such that the needle bar case 21 can move in the left-right direction. Ten needle bars 7 (needle bars 71 to 80; refer to FIG. 2) that extend in the up-down direction are disposed at equal intervals in the left-right direction inside the needle bar case 21. One of the needle bars 7 that is in a sewing position may be moved in the up-down direction by a needle bar drive mechanism 32 (refer to FIG. 5) that is provided inside the needle bar case 21. One of a sewing needle 51 and a cutting blade 52 (refer to FIG. 2) can be attached to the lower end of each of the needle bars 7. That is, the needle bars 7 are configured to receive the cutting blades 52.

Figure 2:
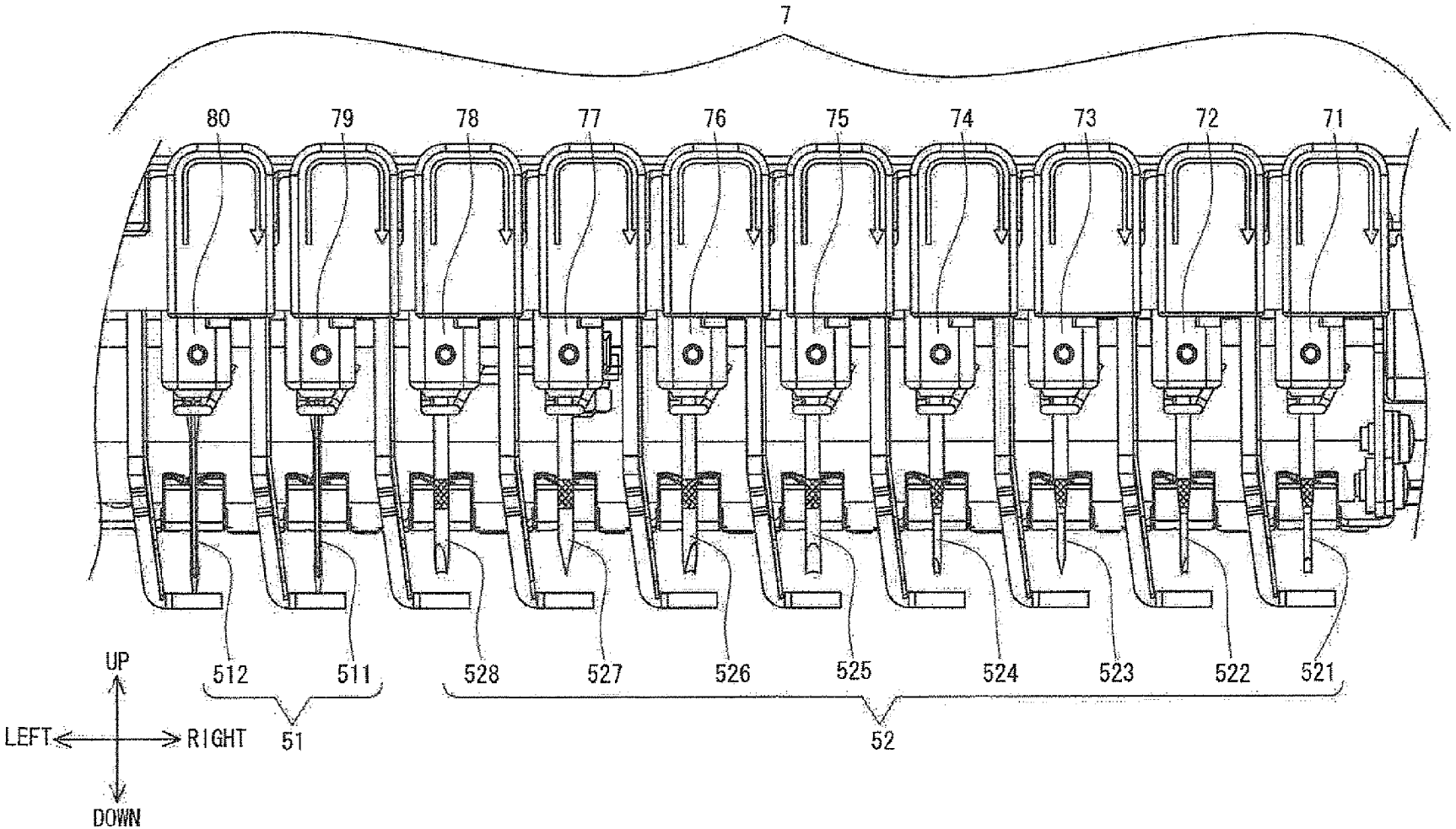
FIG. 2 is a partial front view of a lower end portion of a needle bar case.

In the example that is shown in FIG. 2, the sewing needles 51 (a sewing needle 511 and a sewing needle 512) are attached to the two of the ten needle bars 7 that are farthest to the left (the needle bar 79 and the needle bar 80). The sewing machine 1 may move the sewing needle 51 reciprocally up and down repeatedly by moving the needle bar 7 to which the sewing needle 51 is attached up and down. The sewing machine 1 can thus perform sewing on a work cloth 100 (refer to FIG. 3).

The cutting blades 52 (cutting blades 521 to 528) can be attached to the eight of the ten needle bars 7 that are on the right side (the needle bars 71 to 78). Each of the cutting blades 52 has a cutting edge to form a cut in the work cloth 100 on its lower end. A shaft portion of the upper portion of the cutting blade 52 (refer to FIG. 2) has a partially circular cylindrical shape with a flat surface on one side. A positional relationship between the direction of the cutting edge and the flat surface that is formed on the shaft portion is different for each of the cutting blades 521 to 528. The cutting blade 52 can be attached to the needle bar 7 in a state in which the flat surface on the shaft portion faces toward the rear of the sewing machine 1. Therefore, the plurality of cutting blades 52 can be attached to the sewing machine 1 in a state in which directions of the cutting edges are different from each other. Note that, the direction of the cutting edge is the direction of the cutting edge when the cutting blade 52 forms a cut in the work cloth 100. In other words, the direction of the cutting edge is the direction of the cut to be formed in the work cloth 100. As will be described later, the direction in which the cut that is formed in the work cloth 100 extends, and the length of the cut, is set for each of the cutting blades 521 to 528. The sewing machine 1 may move the cutting blade 52 reciprocally up and down repeatedly by moving the needle bar 7 to which the cutting blade 52 is attached up and down. The sewing machine 1 can thus form the cuts in the work cloth 100. As described later, the sewing machine 1 may sequentially form the cuts in the work cloth 100 while switching the cutting blades 521 to 528.

As shown in FIG. 1, an operation portion 6 is provided to the right of the central portion of the arm 4 in the front-rear direction. The operation portion 6 includes a liquid crystal display 15, a touch panel 8, and a start/stop switch 41. For example an image including various types of items, such as commands, illustrations, a setting value, a message, and the like may be displayed on the liquid crystal display 15 based on image data. The touch panel 8 is provided on the front face of the liquid crystal display 15. A user can perform a pressing operation on the touch panel 8, using a finger or a touch pen. Hereinafter, this operation will be referred to as a panel operation. The touch panel 8 may detect a position pressed by the finger or the touch pen, and the sewing machine 1 (more specifically, a CPU 61 to be described later) may recognize the item that corresponds to the detected position. Thus the sewing machine 1 may recognize the selected item. The user can select a pattern of cuts to be formed in the work cloth 100, a cutting condition, a command to be executed, or the like, by performing a panel operation. The start/stop switch 41 is a switch for inputting commands that cause the sewing machine 1 to start and stop the sewing and the forming of the cuts.

A cylindrical cylinder bed 10 that extends toward the front from the lower end portion of the pillar 3 is provided below the arm 4. A shuttle (not shown in the drawings) is provided inside the front end portion of the cylinder bed 10. The shuttle can house a bobbin (not shown in the drawings), on which a bobbin thread (not shown in the drawings) is wound. A shuttle drive mechanism (not shown in the drawings) is provided inside the cylinder bed 10. The shuttle drive mechanism (not shown in the drawings) may rotationally drive the shuttle. A needle plate, having a rectangular shape in a plan view, is provided in the upper face of the cylinder bed 10. The needle plate 16 is provided with a needle hole 36, through which the sewing needle 51 can pass.

A left-right pair of thread spool holders 12 are provided on the rear portion of an upper face of the arm 4. Ten thread spools 13, the same number as the number of the needle bars 7, can be mounted on the pair of the thread spool holders 12. Needle thread 38 may be supplied from the thread spools 13 mounted on the thread spool holders 12. The needle thread 38 may be supplied via a thread guide 17, a tensioner 18, a thread take-up lever 39, and the like to an eye (not shown in the drawings) of one of the sewing needles 51 that is attached to the lower end of the needle bars 7.

A Y carriage 23 of a movement mechanism 11 (refer to FIGS. 3 and 5) is provided below the arm 4. Various types of embroidery frames 84 (refer to FIG. 3) can be mounted on the movement mechanism 11. That is, the sewing machine 1 is configured to receive the embroidery frame 84. The embroidery frame 84 is configured to hold the work cloth 100. The movement mechanism 11 may cause the embroidery frame 84 to move in the front-rear and left-right directions using an X axis motor 132 (refer to FIG. 5) and a Y axis motor 134 (refer to FIG. 5) as drive sources.

Figure 3:
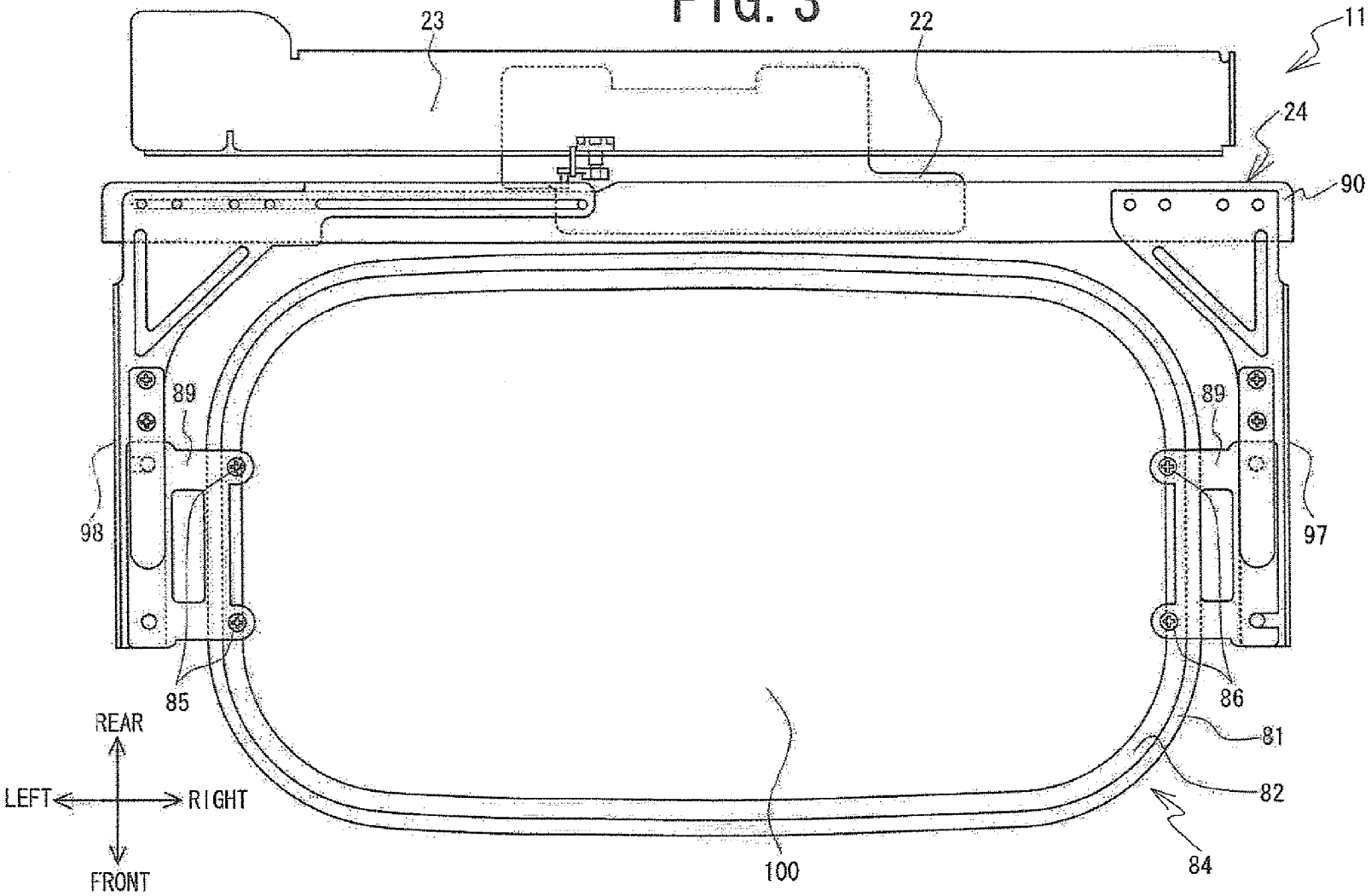
FIG. 3 is a plan view of a movement mechanism on which an embroidery frame is mounted.

The embroidery frame 84 and the movement mechanism 11 will be explained with reference to FIG. 3. The embroidery frame 84 includes an outer frame 81, an inner frame 82, and a left-right pair of coupling portions 89. The outer frame 81 and the inner frame 82 of the embroidery frame 84 may clamp the work cloth 100. Each of the coupling portions 89 is a plate-shaped member having a rectangular shape in a plan view and having a rectangular cut-out in the central portion. One of the coupling portions 89 is fixed to the right portion of the inner frame 82 by screws 86. The other of the coupling portions 89 is fixed to the left portion of the inner frame 82 by screws 85.

The movement mechanism 11 includes a holder 24, an X carriage 22, an X axis drive mechanism (not shown in the drawings), the Y carriage 23, and a Y axis drive mechanism (not shown in the drawings). The holder 24 is configured to detachably support the embroidery frame 84. The holder 24 includes a mounting portion 90, a right arm portion 97, and a left arm portion 98. The mounting portion 90 is a plate member having a rectangular shape in a plan view, and is longer in the left-right direction. The right arm portion 97 extends in the front-rear direction, and a rear end portion of the right arm portion 97 is fixed to the right end of the mounting portion 90. The left arm portion 98 extends in the front-rear direction. The rear end portion of the left arm portion 98 is fixed to a left portion of the mounting portion 90 such that the position in the left-right direction with respect to the mounting portion 90 can be adjusted. The right arm portion 97 may be engaged with one of the coupling portions 89, and the left arm portion 98 may be engaged with the other of the coupling portions 89.

The X carriage 22 is a plate member, and is longer in the left-right direction. A part of the X carriage 22 projects forward from the front face of the Y carriage 23. The mounting portion 90 of the holder 24 may be attached to the X carriage 22. The X axis drive mechanism (not shown in the drawings) includes a linear movement mechanism (not shown in the drawings). The linear movement mechanism includes a timing pulley (not shown in the drawings) and a timing belt (not shown in the drawings), and the linear movement mechanism may cause the X carriage 22 to move in the left-right direction (the X axis direction) using the X axis motor 132 as a drive source.

The Y carriage 23 is a box-shaped member that is longer in the left-right direction. The Y carriage 23 supports the X carriage 22 such that the X carriage 22 can move in the left-right direction. The Y axis drive mechanism (not shown in the drawings) includes a pair of left and right movable members (not shown in the drawings) and a linear movement mechanism (not shown in the drawings). The movable members are connected to the lower portions of the left and right ends of the Y carriage 23 and vertically pass through the guide slots 25 (refer to FIG. 1). The linear movement mechanism includes a timing pulley (not shown in the drawings) and a timing belt (not shown in the drawings). The linear movement mechanism may cause the movable members to move in the front-rear direction (the Y axis direction) along the guide slots 25 using the Y axis motor 134 as a drive source. The Y carriage 23 that is connected to the movable members, and the X carriage 22 that is supported by the Y carriage 23 may move in the front-rear direction (the Y axis direction) in accordance with the movement of the movable members. In a state in which the embroidery frame 84 that holds the work cloth 100 is attached to the X carriage 22, the work cloth 100 is disposed between the needle bars 7 and the needle plate 16 (refer to FIG. 1).

The directions and the lengths of the cuts that may be formed in the work cloth 100 by the cutting blades 521 to 528 that are attached to the needle bars 71 to 78 will be explained with reference to a cutting blade data table 46 shown in FIG. 4. A cut direction is a direction in which a cut extends. A cut length is a length of a cut. The cutting blade data table 46 is stored in an EEPROM 64 (refer to FIG. 5). The cut directions and the cut lengths that correspond to the cutting blades 521 to 528 that are respectively attached to the needle bars 71 to 78 are listed in the cutting blade data table 46 shown in FIG. 4. The cut directions and the cut lengths that are listed in the cutting blade data table 46 are data input by panel operations by the user.

The cut directions respectively correspond to the directions in which the cutting edges of the cutting blades 52 that are attached to the needle bars 7 extend. The cut lengths are the same as the cutting edge widths of the cutting blades 52. For example, the cutting edge of the cutting blade 521 attached to the needle bar 71 extends in the left-right direction of the sewing machine 1 (refer to FIG. 2). Therefore, the direction of the cut that is formed in the work cloth 100 by the cutting blade 521 is in the left-right direction. In the present embodiment, the left-right direction of the sewing machine 1 corresponds to a cut direction of zero degrees. A direction from the left front toward the right rear corresponds to a cut direction of 45 degrees. The front-rear direction corresponds to a cut direction of 90 degrees. A direction from the right front toward the left rear corresponds to a cut direction of 135 degrees. The cut direction of zero degrees is listed in the cutting blade data table 46 in association with the cutting blade 521. A cut length of 1.5 millimeters is also listed in association with the cutting blade 521.

The cut length for each of the cutting blades 521 to 524 is 1.5 millimeters. The cut length for each of the cutting blades 525 to 528 is 3 millimeters, which is twice of 1.5 millimeters. The cut directions for the cutting blade 521 and the cutting blade 525 are the same at zero degrees. The cut directions for the cutting blade 522 and the cutting blade 526 are the same at 45 degrees. The cut directions for the cutting blade 523 and the cutting blade 527 are the same at 90 degrees. The cut directions for the cutting blade 524 and the cutting blade 528 are the same at 135 degrees. That is, the cutting blades 525 to 528 have respectively the same cut directions as the cutting blades 521 to 524 and have cut lengths that are twice as long.

Figure 5:
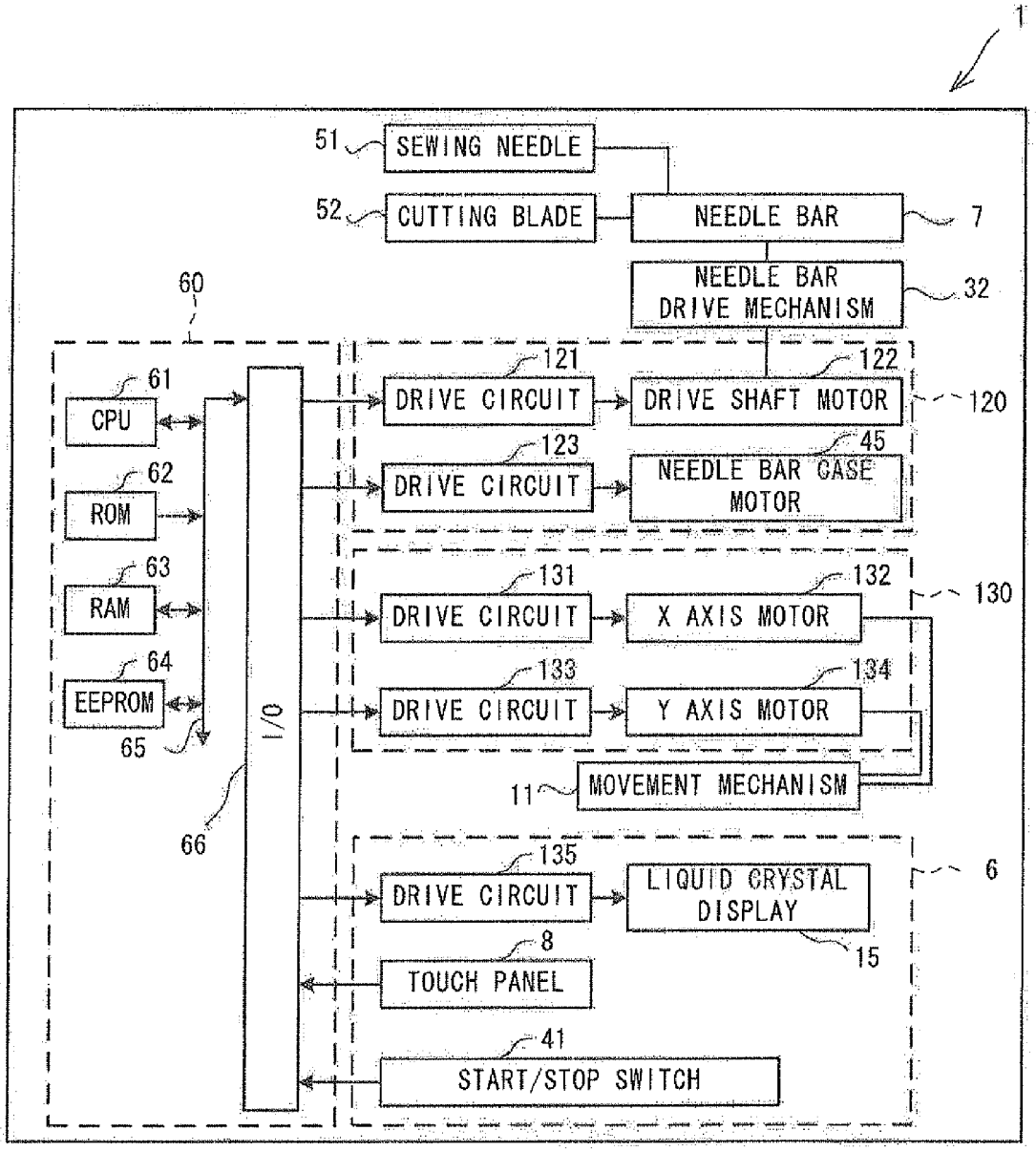
FIG. 5 is a block diagram showing an electrical configuration of the sewing machine.

An electrical configuration of the sewing machine 1 will be explained with reference to FIG. 5. As shown in FIG. 5, the sewing machine 1 includes a sewing needle drive portion 120, a sewn object drive portion 130, the operation portion 6, and a control portion 60. The sewing needle drive portion 120 includes a drive circuit 121, a drive shaft motor 122, a drive circuit 123, and a needle bar case motor 45. The drive circuit 121 may drive the drive shaft motor 122 in accordance with a control signal from the control portion 60. The drive shaft motor 122 may drive the needle bar drive mechanism 32 by rotationally driving a drive shaft (not shown in the drawings), and cause the needle bar 7 to reciprocate up and down. The drive circuit 123 may drive the needle bar case motor 45 in accordance with a control signal from the control portion 60. The needle bar case motor 45 may drive a movement mechanism that is not shown in the drawings and thereby cause the needle bar case 21 to move in the left-right direction.

The sewn object drive portion 130 includes a drive circuit 131, the X axis motor 132, a drive circuit 133, and the Y axis motor 134. The drive circuit 131 may drive the X axis motor 132 in accordance with a control signal from the control portion 60. The X axis motor 132 may drive the movement mechanism 11 and thereby cause the embroidery frame 84 (refer to FIG. 3) to move in the left-right direction by driving the movement mechanism 11. The drive circuit 133 may drive the Y axis motor 134 in accordance with a control signal from the control portion 60. The Y axis motor 134 may drive the movement mechanism 11 and thereby cause the embroidery frame 84 to move in the front-rear direction.

The operation portion 6 includes the touch panel 8, a drive circuit 135, the liquid crystal display 15, and the start/stop switch 41. The drive circuit 135 may drive the liquid crystal display 15 in accordance with a control signal from the control portion 60.

The control portion 60 includes the CPU 61, a ROM 62, a RAM 63, the EEPROM 64, and an input/output interface (I/O) 66, which are mutually connected by a signal line 65. The sewing needle drive portion 120, the sewn object drive portion 130, and the operation portion 6 are each connected to the I/O 66.

The CPU 61 is configured to perform main control of the sewing machine 1. The CPU 61 may perform various operations and processing that relate to sewing, in accordance with various programs stored in a program storage area (not shown in the drawings) of the ROM 62. Although these are not shown in the drawings, the ROM 62 includes a plurality of storage areas that include the program storage area. Various programs for operating the sewing machine 1, including a main program, may be stored in the program storage area. The main program is a program for performing first main processing that will be described later. The RAM 63 includes, as necessary, storage areas to store data such as operation results and the like processed by the CPU 61. In addition to the cutting blade data table 46 (refer to FIG. 4), various parameters for the sewing machine 1 to perform various processing may be stored in the EEPROM 64.

The first main processing will be explained with reference to FIG. 6. In the first main processing, cut data (for example, data that are stored in a cut data table 47 that is shown in FIG. 16) are generated. The cut data are control data that is necessary to cause the sewing machine 1 to perform operations to form cuts in the work cloth 100 along a line that indicates a shape of a pattern. A line that indicates a shape of a pattern will be hereinafter referred to as a pattern line. The sewing machine 1 may form the cuts in the work cloth 100 along the pattern line based on the generated cut data.

Figure 6:
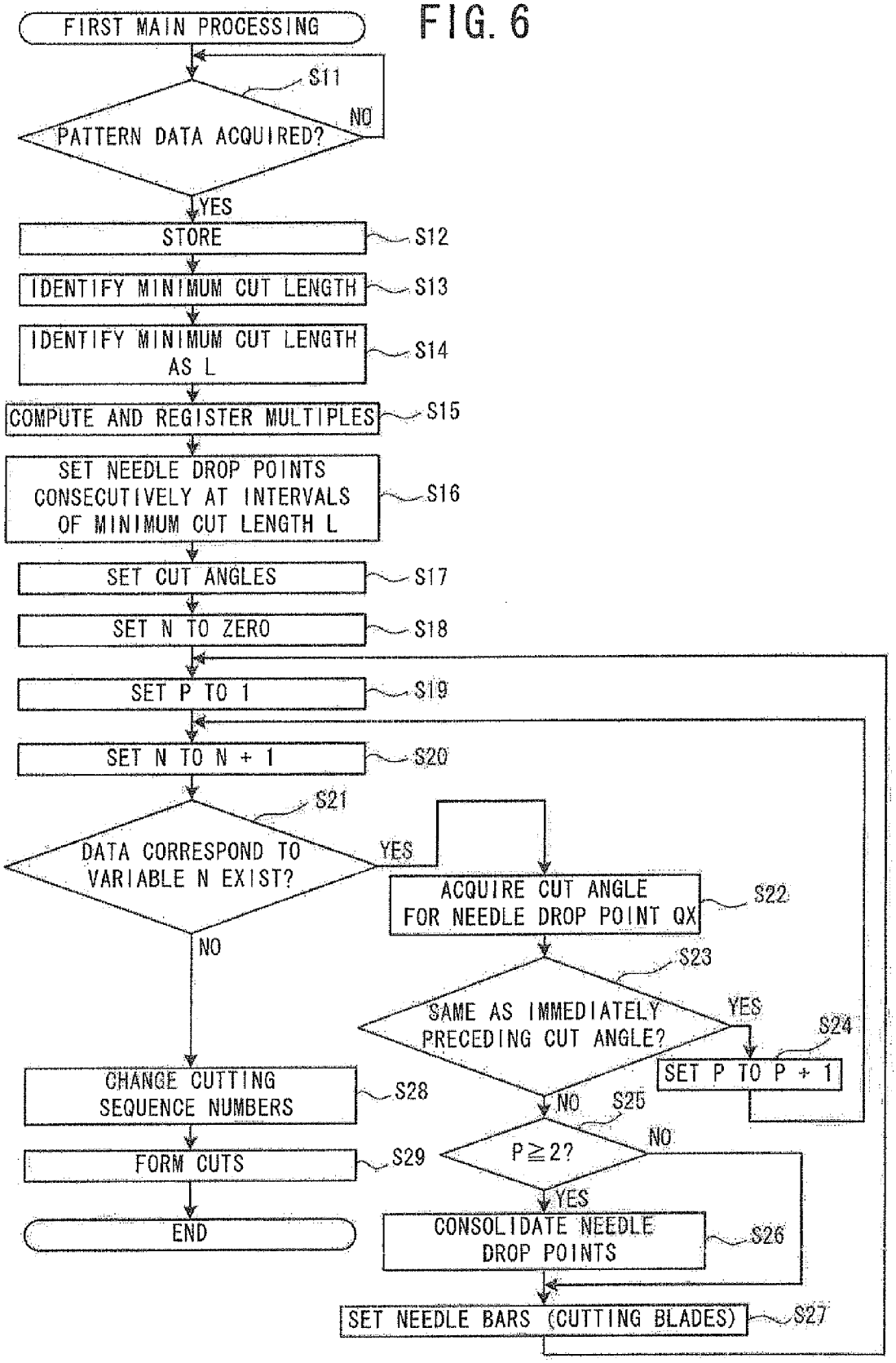
FIG. 6 is a flowchart of first main processing.

The first main processing that is shown in FIG. 6 is performed in a case where the user inputs a command to start the first main processing. The command to start the first main processing may be input by a panel operation, for example. The program for performing the first main processing is stored in the ROM 62 (refer to FIG. 5) and is performed by the CPU 61.

As shown in FIG. 6, first, the CPU 61 determines whether pattern data have been acquired (Step S11). The pattern data are data for a pattern line along which cuts are to be formed. For example, the pattern data are data that represent a position of a given point on the pattern line with respect to the work cloth 100, in a case where cuts are formed along the pattern line on the work cloth 100. The pattern data may be vector data, for example. The user may input a shape of the pattern line by a panel operation. The CPU 61 may then acquire the data indicating the input pattern line as the pattern data. In a case where the pattern data have not been acquired (NO at Step S11), the CPU 61 repeats the processing at Step S11.

Figure 7:
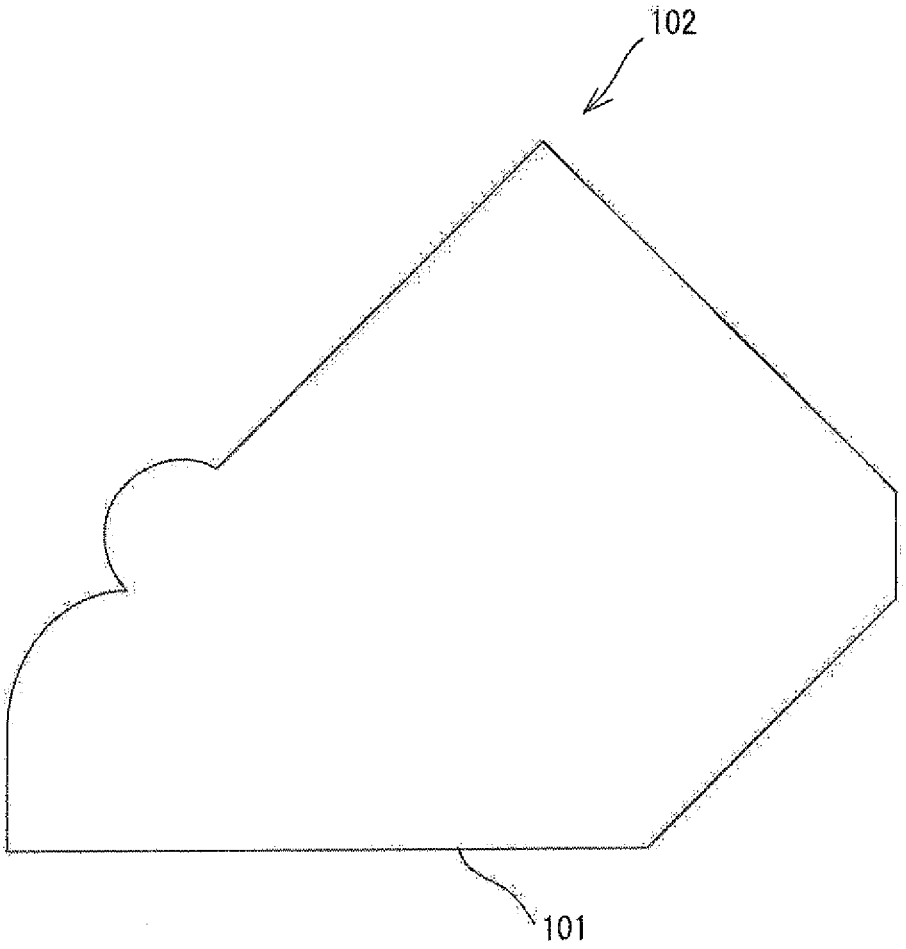
FIG. 7 is an explanatory figure of a pattern.

In a case where a pattern line 101 for a ring-like pattern 102, as shown in FIG. 7, has been input, the CPU 61 acquires the pattern data indicating the pattern line 101. In a case where the pattern data for the pattern line 101 have been acquired (YES at Step S11), the CPU 61 stores the acquired pattern data in the RAM 63 (Step S12).

The CPU 61 may also acquire the pattern data by another method. For example, the user may input a plurality of points as the pattern line by a panel operation. The CPU 61 may acquire data representing line segments that connect the plurality of input points as the pattern data. The sewing machine 1 may be provided with a card slot not shown in the drawings, for example. The user may insert into the card slot a memory card in which the pattern data are stored. The CPU 61 may acquire the pattern data by reading out the pattern data stored in the memory card inserted into the card slot.

Next, the CPU 61 identifies a minimum cut length by referring to the cutting blade data table 46 (refer to FIG. 4) (Step S13). The minimum cut length is the shortest cut length among the cut lengths for the cutting blades 52 (the cutting blades 521 to 528) that are attached to the needle bars 7. The CPU 61 identifies the minimum cut length as L that was identified at Step S13 and stores the minimum cut length L in the cutting blade data table 46 (Step S14). For the cutting blades 52 that are associated with cut lengths other than the minimum cut length, the CPU 61 computes multiples of the minimum cut length L. Based on the computed multiples, the CPU 61 stores the cut lengths that respectively correspond to the cutting blades 52 in the cutting blade data table 46 (Step S15).

For example, in the case of the cutting blade data table 46 that is shown in FIG. 4, the needle bars 71 to 74 are each associated with the minimum cut length of 1.5 millimeters. Therefore, the CPU 61 identifies 1.5 millimeters as the minimum cut length (Step S13) and identifies 1.5 millimeters as L (Step S14). For the needle bars 75 to 78, with which cut lengths other than the minimum cut length are associated, the CPU 61 computes multiples of the minimum cut length L. The CPU 61 registers the computation results in the cutting blade data table 46 (Step S15). In this manner, the minimum cut length L is associated with each of the needle bars 71 to 74, and the cut length 2L is associated with each of the needle bars 75 to 78 as shown in FIG. 8.

Figure 9:
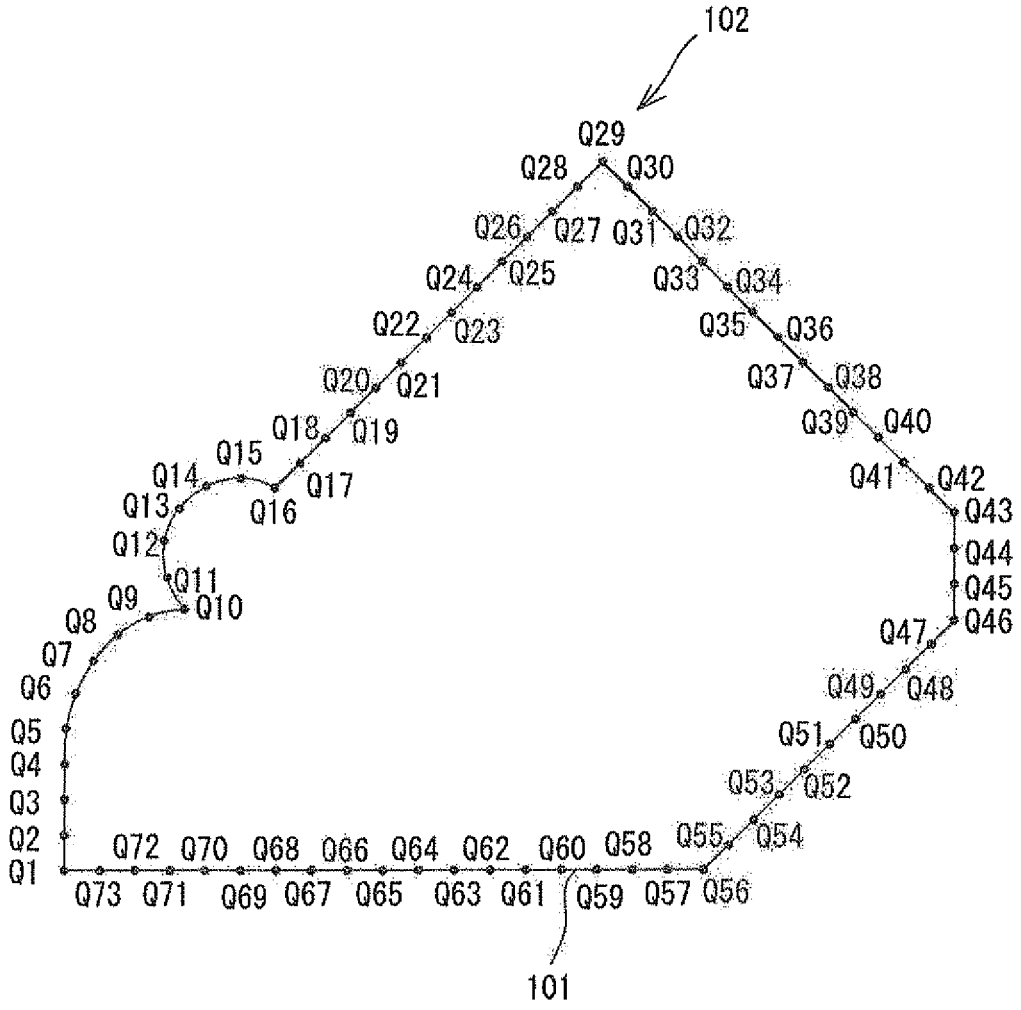
FIG. 9 is an explanatory figure of needle drop points on a pattern line.

The CPU 61 sets needle drop points consecutively at predetermined intervals along the pattern line 101 that is indicated by the pattern data stored in the RAM 63 (Step S16). In the present embodiment, the predetermined interval is equal to the minimum cut length L. The positions (the coordinates) of the set needle drop points are stored in the cut data table 47 (refer to FIG. 10 and the like) stored in the RAM 63. For example, in a case where the pattern line 101 shown in FIG. 7 has been input, the CPU 61 sets the needle drop points such that the needle drop points are arranged at the predetermined intervals along the pattern line 101. In this case, needle drop points QX (X=1, 2, . . . 73) are set consecutively along the pattern line 101 as shown in FIG. 9. Note that QX is the number of the needle drop point. The numerical values for X are assigned consecutively to the set needle drop points along the pattern line 101, such that the numerical value of a particular needle drop point on the pattern line 101 is taken as 1 (the point at the lower left in the example in FIG. 9). Then the data for the (X, Y) coordinates for the set needle drop points Q1 to Q73 are registered in the cut data table 47, as shown in FIG. 10. Note that, hereinafter, the coordinate data for the needle drop points QX are sometimes simply referred to as the needle drop points QX. At this time, cutting sequence numbers from 1 to 73 are also assigned consecutively to the needle drop points Q1 to Q73.

The CPU 61 sets a cut angle for each of the needle drop points QX that was set by the processing at Step S16 (Step S17). The cut angle is an angle of a cut along the pattern line. More specifically, the cut angle is an angle that is set based on the direction in which the pattern line extends at each of the needle drop points. For example, in the processing at Step S17, among the cut directions that are stored in the cutting blade data table 46 for the plurality of cutting blades 521 to 528, the cut direction that is the closest to the direction in which the pattern line 101 extends at the needle drop point QX is set as the cut angle. The setting process will hereinafter be described in detail.

Figure 11:
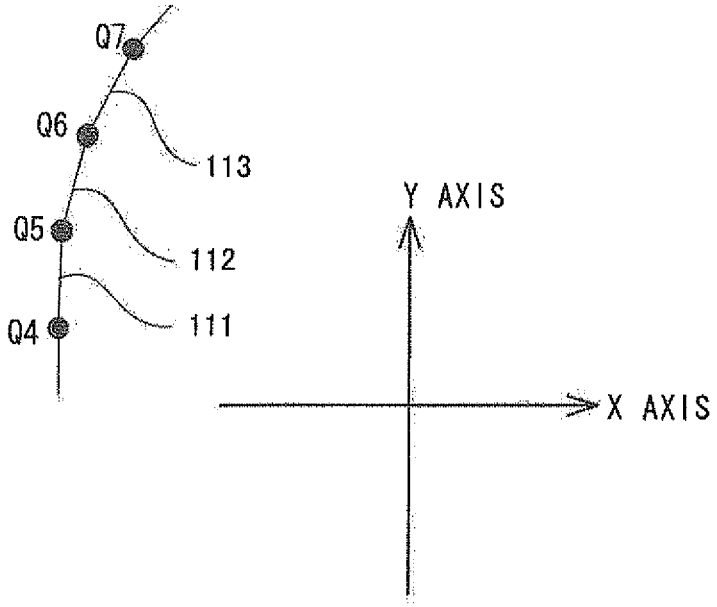
FIG. 11 is an explanatory figure of a method for specifying a cut angle.

The method for setting the cut angle will be explained in detail with reference to FIG. 11. First, as shown in FIG. 11, line segments 111, 112, 113 that respectively connect two adjacent needle drop points QX (Q4 to Q5, Q5 to Q6, and Q6 to Q7) are defined. Then, with the needle drop point Q4 serving as a reference point, the positive direction of the X axis indicating zero degrees and the positive direction of the Y axis indicating 90 degrees, the CPU 61 identifies the angle that is formed between the line segment 111 and the X axis as the direction in which the line segment 111 extends. The CPU 61 identifies the directions in which the line segments 112, 113 extend in the same manner. Among the cut directions of zero degrees, 45 degrees, 90 degrees, and 135 degrees that are registered in the cutting blade data table 46 (refer to FIG. 8), the cut direction that is the closest to the direction in which the line segment 111 extends is set as the cut angle of the line segment 111. The CPU 61 sets the cut angles of the line segments 112 and 113 in the same manner. For example, the CPU 61 subtracts each of the cut directions that have been registered in the cutting blade data table 46 from the direction in which the line segment 111 extends. The CPU 61 then identifies, as the cut direction that is the closest to the line segment 111, the cut direction for which the result of the subtraction is closest to zero. For example, in a case where it is determined that the direction in which the line segment 111 extends is closest to the cut direction of 90 degrees, the cut angle for each of the needle drop points Q4 and Q5 positioned at both ends of the line segment 111 is set to 90 degrees. In the same manner, in a case where it is determined that the direction in which the line segment 112 extends is closest to the cut direction of 90 degrees, the cut angle for each of the needle drop points Q5 and Q6 positioned at both ends of the line segment 112 is set to 90 degrees. In a case where it is determined that the direction in which the line segment 113 extends is closest to the cut direction of 45 degrees, the cut angle for each of the needle drop points Q6 and Q7 positioned at both ends of the line segment 113 is set to 45 degrees.

In a case where the cut angles are set for all of the needle drop points QX, the data for the cut angles are registered in the cut data table 47 shown in FIG. 10, and the cut angle column of the cut data table 47 is filled, as shown in FIG. 12. The directions in which the line segment 111 and the line segment 112 extend are both closest to the cut direction of 90 degrees (refer to FIG. 11). Therefore, the CPU 61 sets the cut angle for the needle drop point Q5, which is at one end of each of the line segments 111 and 112, to 90 degrees, as shown in FIG. 12. The direction in which the line segment 112 extends is closest to 90 degrees, and the direction in which the line segment 113 extends is closest to 45 degrees (refer to FIG. 11). Therefore, for the cut angle of the needle drop point Q6, which is at one end of each of the line segments 112 and 113, the CPU 61 sets the two cut angles to 90 degrees and 45 degrees. Note that in a case where two cut angles such as 90 degrees and 45 degrees are set for a single needle drop point QX, each of the two cutting blades 52 that have the corresponding cut directions forms one cut at the single needle drop point QX. Furthermore, for the needle drop point Q1, which is the first needle drop point, the cut angles are set based on the directions in which the line segment from Q1 to Q2 and the line segment from Q73 (the final needle drop point) to Q1 respectively extend. For the needle drop point Q73, which is the final needle drop point, the cut angles are set based on the directions in which the line segment from Q72 to Q73 and the line segment from Q73 to Q1 respectively extend.

Next, the CPU 61 sets a variable N to zero (Step S18). The variable N is a variable that indicates the cutting sequence number in the cut data table 47 (refer to FIG. 12). The CPU 61 sets a variable P to 1 (Step S19). The variable P is a variable that the CPU 61 uses to count the number of the consecutive needle drop points QX for which the cut angles are the same. The CPU 61 increments the variable N by increasing the value of the variable N by 1 (Step S20). By referring to the cut data table 47, the CPU 61 determines whether data exist for the cutting sequence number that corresponds to the variable N (Step S21). Note that a case in which the data do not exist for the cutting sequence number that corresponds to the variable N is a case in which the processing at Steps S22 to S27, which is described later, has been performed for all of the needle drop points QX.

In a case where the data exist for the cutting sequence number that corresponds to the variable N (YES at Step S21), the CPU 61 refers to the cut data table 47 and acquires the cut angle for the needle drop point QX with the cutting sequence number that corresponds to the variable N (Step S22). The CPU 61 determines whether the cut angle for the needle drop point QX that was acquired by the processing at Step S22 is the same as the cut angle for the needle drop point QX that corresponds to the variable N minus 1 (Step S23). In other words, the CPU 61 determines whether the cut angles for the consecutive needle drop points QX are the same. In a case where the cut angles are the same (YES at Step S23), the CPU 61 increments the variable P by increasing the value of the variable P by 1 (Step S24). In this manner, the number of the consecutive needle drop points QX for which the cut angles are the same is counted. The CPU 61 returns the processing to the processing at Step S20.

In a case where the CPU 61 has determined that the cut angles are not the same (NO at Step S23), the CPU 61 determines whether the variable P is 2 or more (Step S25). In other words, the CPU 61 determines whether consecutive needle drop points QX exist for which the cut angles are the same. In a case where the successive cut angles are not the same and the variable P is 1 (NO at Step S25), the CPU 61 advances the processing to the processing at Step S27, which will be described later.

In a case where the variable P is 2 or more (YES at Step S25), the CPU 61, based on the cut lengths that are stored in the cutting blade data table 46, consolidates at least a part of the at least two consecutive needle drop points QX for which the cut angles are the same into a single needle drop point (Step S26). In the explanation that follows, the needle drop point into which the other needle drop points have been consolidated by the processing at Step S26 is referred to as the needle drop point QX'. Specifically, first, the cut angles for the consecutive needle drop points QX for which the cut angles are the same are identified. For example, in the cut data table 47 (refer to FIG. 12), the cut angle 45 degrees is associated with each of the needle drop points Q17 to Q28. Therefore, 45 degrees is identified as the consecutively identical cut angle. Next, the cutting blade data table 46 is referenced, and from among the cut lengths that are associated with the specified cut angle of 45 degrees, the cut length 2L is identified as the cut length for which the multiple is closest to the variable P while not exceeding the value of the variable P. The needle drop points Q17 to Q28 are set consecutively at intervals of the minimum cut length L. The CPU 61 consolidates two of the consecutive needle drop points QX that are each associated with the cut length L into the single needle drop point QX', which is associated with the cut length 2L. The CPU 61 computes an intermediate point between the two needle drop points QX and then consolidates the two needle drop points QX into the single needle drop point QX' at the computed intermediate point. For example, coordinates for Q17 are (X17, Y17), and coordinates for Q18 are (X18, Y18). Accordingly, the X coordinate for the intermediate point is {(X17+X18)/2}, and the Y coordinate for the intermediate point is {(Y17+Y18)/2}. Thus the two needle drop points Q17, Q18 that are shown in FIG. 12 are consolidated into a needle drop point Q17'((X17+X18)/2, (Y17+Y18)/2), as shown in FIG. 13. Note that the cutting sequence numbers are changed in the order of the X values of the needle drop points QX and QX'. Some of the other needle drop points QX may also be consolidated in the same manner.

Figure 14:
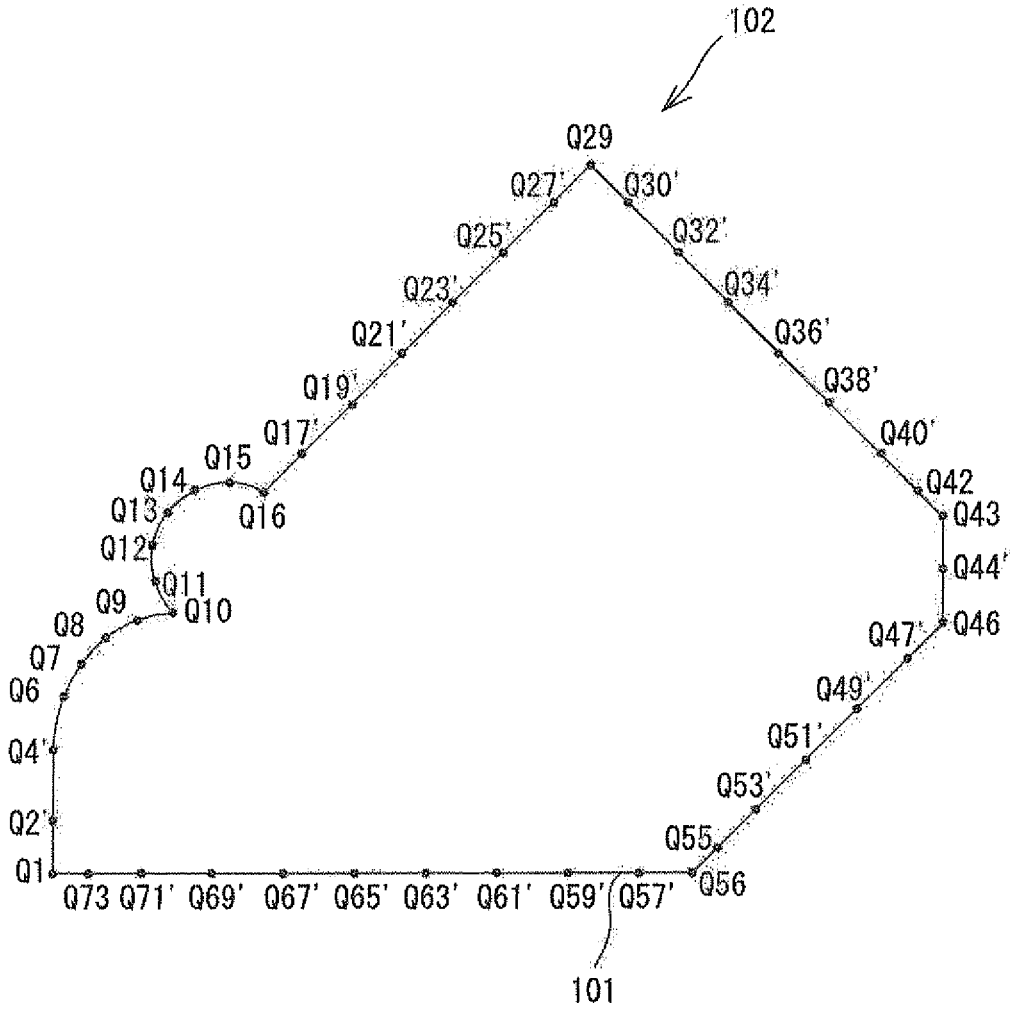
FIG. 14 is an explanatory figure of the needle drop points on the pattern line after some of the needle drop points have been consolidated.

FIG. 14 is a figure that shows the needle drop points QX' that have been consolidated by the processing at Step S26, and the unconsolidated needle drop points QX, on the pattern line 101. In the present embodiment, the sets of two consecutive needle drop points QX for which the cut angles are the same are each consolidated into the needle drop points QX'. Therefore, as shown in FIG. 14, the total number of the needle drop points QX and the needle drop points QX' is less than the number of the needle drop points before the processing at Step S26 was performed (refer to FIG. 9).

Next, based on the cut lengths and the cut directions stored in the cutting blade data table 46, the CPU 61 sets for each of the needle drop points QX', the needle drop points QX' and QX, or the needle drop points QX, as the case may be, from among the plurality of needle bars 71 to 78, one of the needle bars 7 to which one of the cutting blades 52 is attached. That is, the CPU 61 identifies for each of the needle drop points QX', the needle drop points QX' and QX, or the needle drop points QX, as the case may be, from among the plurality of needle bars 71 to 78, one of the needle bars 7 to which one of the cutting blades 52 is attached. The CPU 61 registers the data that indicate the needle bars 7 that have been set in the cut data table 47 in association with the corresponding needle drop points QX and needle drop points QX' (Step S27). For example, the needle drop point Q7 has not been consolidated by the processing at Step S26 (the position (coordinates) has not been changed). The cut angle 45 degrees has been associated with the needle drop point Q7 by the processing at Step S17. The needle drop point Q7 is also a needle drop point for which the intervals between the needle drop point Q7 and the adjacent needle drop points Q6 and Q8 have both been set to the same interval, the cut length L. Accordingly, the CPU 61 refers to the cutting blade data table 46 (refer to FIG. 8) and sets the needle bar 72, to which the cutting blade 522, which is associated with the cut angle 45 degrees and the cut length L, has been attached. Then the data that indicate the needle bar 72 are registered in the cut data table 47 in association with the needle drop point Q7, as shown in FIG. 15. The needle drop point Q17 and the needle drop point Q18 have been consolidated into the needle drop point Q17' by the processing at Step S26 (the position (coordinates) has been changed). The cut angle 45 degrees is associated with the needle drop point Q17'. The needle drop point Q17' is the needle drop point QX', generated by consolidating the two needle drop points Q17 and Q18, for which the intervals are set to the cut length L, into a single needle drop point. Therefore, in a case where the cutting blade 52 is inserted at the needle drop point Q17', it is necessary for the cut length that is formed to be 2L. Accordingly, the CPU 61 refers to the cutting blade data table 46 (refer to FIG. 8) and sets the needle bar 76, to which the cutting blade 526, which is associated with the cut angle 45 degrees and the cut length 2L, is attached. Then the data indicating the needle bar 76 are registered in the cut data table 47 in association with the needle drop point Q17', as shown in FIG. 15. After the CPU 61 has set one of the needle bars 7 to which one of the cutting blades 52 is attached in the processing at Step S27, the CPU 61 returns the processing to the processing at Step S19, and sets the variable P to 1.

In a case where the CPU 61 has performed the processing at Steps S22 to S27 for all of the needle drop points QX, the CPU 61 determines that the data do not exist for the cutting sequence number that corresponds to the variable N (NO at Step S21). The CPU 61 changes the cutting order for the needle drop points QX and the needle drop points QX' such that the same cutting blade 52 is to be used consecutively when the sewing machine 1 is operated (Step S28). In the processing at Step S28, the data that are registered in the cut data table 47 are rearranged such that all of the data that are associated with the same needle bar 7 (the same cutting blade 52) are grouped together consecutively into a single series. For example, in FIG. 15, the needle bar 76 (the cutting blade 526) is associated with the needle drop points Q17' to Q27' and the needle drop points Q47' to Q53'. Accordingly, as shown in FIG. 16, the cutting order for the needle drop points is rearranged such that the needle drop points Q17' to Q27' and the needle drop points Q47' to Q53' are grouped together consecutively into a single series. The cutting order is rearranged in the same manner for the other needle bars 71, 72, 73, 74, 75, 77, 78. Note, for example, the needle bar 71 and the needle bar 73 are associated with the needle drop point Q1 (refer to FIG. 15). In this case, the cutting order is rearranged such that the needle drop point Q1 is associated separately with both the needle bar 71 and the needle bar 73. Therefore, as shown in FIG. 16, for example, the needle drop point Q1 is associated separately with both the needle bar 71 and the needle bar 73. The cutting order is arranged for all of the needle drop points QX, QX' such that the cutting blades 52 that are respectively attached to the needle bars 71, 72, 73, 74, 75, 76, 77, 78 are to be used in this order when the sewing machine 1 is operated. After the cutting order has been rearranged, the cutting sequence numbers are reassigned in order, starting from the beginning. The data that are registered in the cut data table 47 after being rearranged in this manner are referred to as the cut data.

The CPU 61 causes the sewing machine 1 to form the cuts along the pattern line 101 in accordance with the cut data (Step S29). More specifically, the CPU 61 reads in order the data that correspond to the cutting sequence numbers in the cut data table 47 and moves the needle bar case 21 such that the needle bar 7 that is specified for the current cutting sequence number is disposed in the sewing position. By moving the embroidery frame 84, the CPU 61 also changes the position in which the work cloth 100 is held in relation to the cutting blade 52, such that the cutting blade 52 is disposed directly above the position that is specified by the coordinates of the needle drop point. The CPU 61 then moves the needle bar 7, to the lower end of which the cutting blade 52 is attached, up and down. The cutting blade 52 thus moves reciprocally up and down, repeatedly piercing the work cloth 100 to cut the threads of the work cloth 100 along the pattern line 101. The cut is thus formed in the work cloth 100 along the pattern line 101. In a case where the CPU 61 has finished forming the cut using the needle bar 7 specified for the last cutting sequence number, the CPU 61 terminates the first main processing.

The CPU 61 performs the processing in the present embodiment as described above. The cut angles that are set at Step S17 for the consecutive needle drop points QX along a straight-line portion of the pattern line 101 are all the same angle. In this case, at least some of the consecutive needle drop points QX that have the same cut angle are consolidated into the single needle drop point QX', based on the cut lengths that are stored in the cutting blade data table 46 (Step S26). The needle bar 7 to which is attached the cutting blade 52 that is to be inserted at the consolidated needle drop point QX' is set from among the plurality of needle bars 71 to 78 and is registered in the cut data table 47 (Step S27). Because some of needle drop points QX are consolidated into the single needle drop point QX', the number of the needle drop points is reduced. Consequently, when the cuts are formed along the pattern line 101 by the processing at Step S29, the number of times that the needle bar 7 moves up and down in order to cut along the straight-line portion of the pattern line 101 is reduced. The sewing machine 1 can cut along the straight-line portion of the pattern line 101 in a shorter time, making it possible to cut the work cloth 100 more efficiently.

The cut angles for the consecutive needle drop points QX along a curved-line portion of the pattern line 101 are not the same angle. Therefore, the processing at Step S26 is not performed, and none of the needle drop points QX are consolidated into the needle drop point QX'. The interval between two adjacent needle drop points QX that have not been consolidated is a predetermined interval (in the present embodiment, the minimum cut length L). Therefore, the interval between the two adjacent needle drop points QX that have not been consolidated is less than the interval between the consolidated needle drop point QX' and the adjacent needle drop point QX. Then the needle bar 7 to which the cutting blade 52 is attached that is to be inserted at the needle drop point QX is set based on the cut length (Step S27). In this case, the cutting blade 52 that is attached to the needle bar 7 that has been set is one of the cutting blades 521 to 524, for which the cut length is L. In other words, the sewing machine 1 can specify, as the cutting blade 52 that is to be inserted at the needle drop point QX, one of the cutting blades 521 to 524 (cut length L), for which the cut length is shorter than the cut length for the cutting blades 525 to 528 (cut length 2L). Therefore, it is possible to form the cuts in the curved-line portion by using the cutting blades 521 to 524, for which the cut length is shorter than the cut length for the cutting blades 525 to 528. In this manner, the sewing machine 1 can generate the cut data for forming precise cuts along the curved-line portion of the pattern line 101, as well as for cutting along the straight-line portion of the pattern line 101 in a shorter time.

Furthermore, in the present embodiment, the predetermined interval that is used in the setting of the needle drop points QX by the processing at Step S16 is equal to the minimum cut length L. In this case, in a case where the cutting blades 52 to be inserted at the needle drop points QX are set by the processing at Step S27 based on the cut length, the needle bars 7 to which the cutting blades 521 to 524 are attached can be set, having the minimum cut length L that is the same as the predetermined interval. Accordingly, the sewing machine 1 can form the cuts in the work cloth 100 using the cutting blades 521 to 524 with the cut length L, which is the same as the interval between the two adjacent needle drop points QX and thereby form precise cuts in the work cloth 100. Note that the predetermined interval may also be other than the minimum cut length L. For example, in a case where a plurality of cutting blades having different cut lengths (for example, L, 2L, 3L) are attached to a plurality of needle bars 7, respectively, the predetermined interval may be set to the same length as any one of the plurality of different cut lengths. In that case as well, the sewing machine 1 can form the cuts in the work cloth 100 using the cutting blades with the cut length that is the same as the interval between the two adjacent needle drop points QX and thereby form precise cuts in the work cloth 100 along the pattern line 101.

In the present embodiment, the cut length is the same as the cutting edge width of the cutting blade 52. Because the cut length and the cutting edge width are the same, the external appearance of the cutting blade 52 matches the cut length. Therefore, for example, in a case where the user registers the cut length in the cutting blade data table 46, the user can register the cut length based on the external appearance of the cutting blade 52.

In the present embodiment, the cut lengths of the plurality of cutting blades 52 are set to integer multiples of the minimum cut length L (in the present embodiment, L and 2L). The predetermined interval when the needle drop points QX are set by the processing at Step S16 is the same as the minimum cut length L. Furthermore, in a case where at least some of the consecutive needle drop points QX for which the cut angles are the same are consolidated into the needle drop points QX' by the processing at Step S26, the interval between two of the consolidated needle drop points QX' that are adjacent to one another is an integer multiple of the minimum cut length L. In the processing at Step S27, for each of the needle drop points QX that were not consolidated by the processing at Step S26, one of the needle bars 71 to 74, to which the cutting blades 521 to 524 that have the minimum cut length L are attached, is set as the needle bar 7 to which is attached the cutting blade 52 that is to be inserted at the needle drop point QX. In addition, one of the needle bars 75 to 78 that have cut lengths of 2L, which is an integer multiple of the minimum cut length L, is set as the needle bar 7 to which is attached the cutting blade 52 that is to be inserted at the consolidated needle drop point QX. The cut lengths of the cutting blades 52 correspond to the intervals between the pairs of adjacent needle drop points. Therefore, in a case where the CPU 61 sets the needle bars 7 in the processing at Step S27, the CPU 61 can set the needle bars 7 to which are attached the appropriate cutting blades 52 for inserting at the respective needle drop points QX, QX'.

In the present embodiment, in the processing at Step S28, the cutting order for the needle drop points QX and the needle drop points QX' is changed such that cuts are formed consecutively by the same cutting blade 52. When the sewing machine 1 switches the cutting blade 52, stopping the rotation of the drive shaft motor 122 and moving the needle bar case 21 in the left-right direction are necessary. Therefore, in a case where the cutting blade 52 is switched frequently, the sewing machine 1 takes more time to finish forming the cuts along the pattern line 101 in the work cloth 100 than in a case where the same cutting blade 52 is used continuously. In the present embodiment, the cutting order for the needle drop points QX and the needle drop points QX' is changed such that the same cutting blade 52 is used consecutively. Therefore, when the sewing machine 1 performs the cutting at Step S29, the cuts can be formed consecutively by the same cutting blade 52. Therefore, the number of times that the cutting blade 52 is switched (the needle bar 7 is switched) is less than in a case where the cutting order is not changed. Accordingly, the time that the sewing machine 1 requires in order to form the cuts along the pattern line 101 can be shortened, and the cuts can be formed in the work cloth 100 more efficiently.

Figure 17:
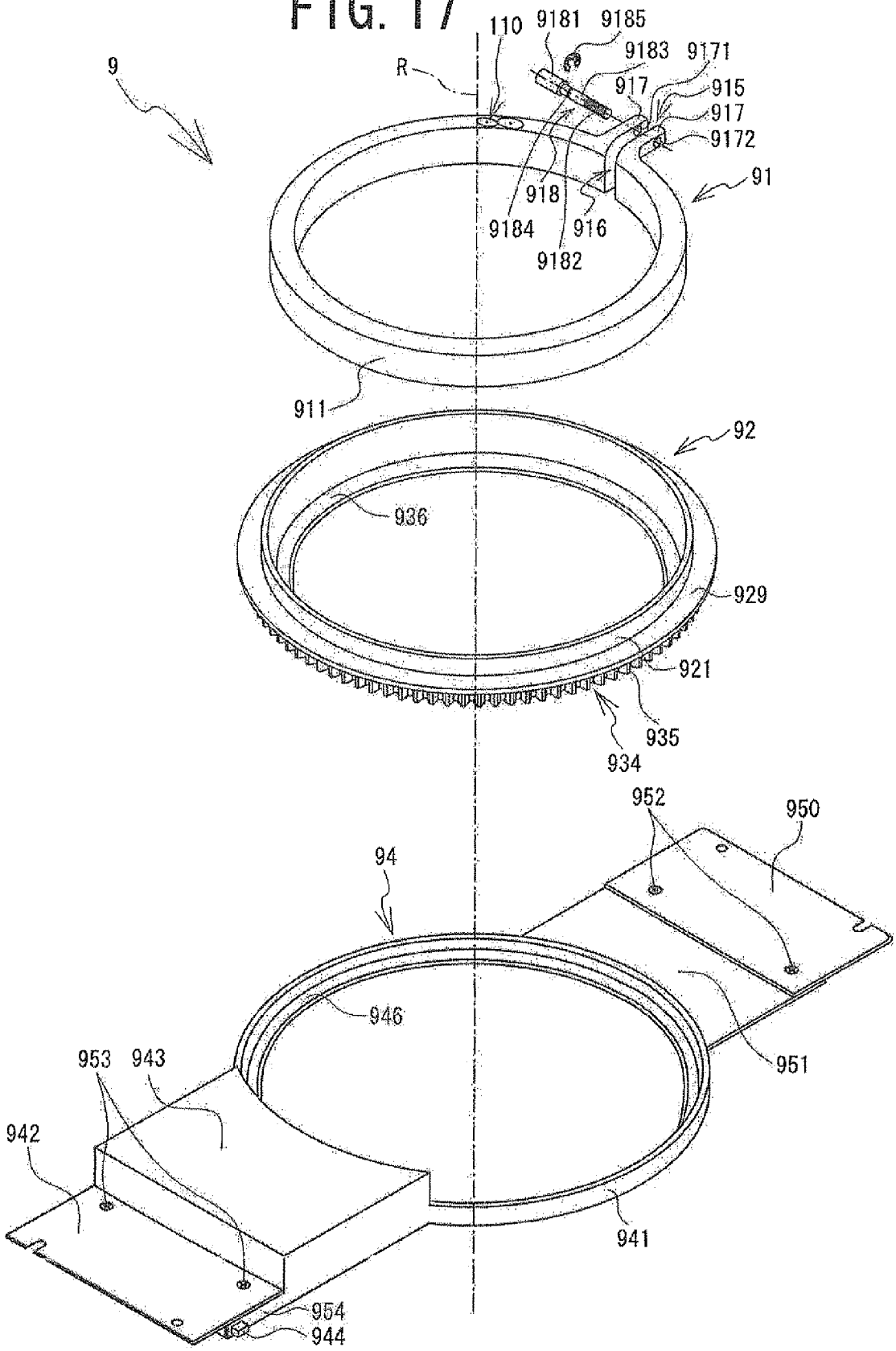
FIG. 17 is an exploded oblique view of a rotatable embroidery frame according to a second embodiment.
Figure 18:
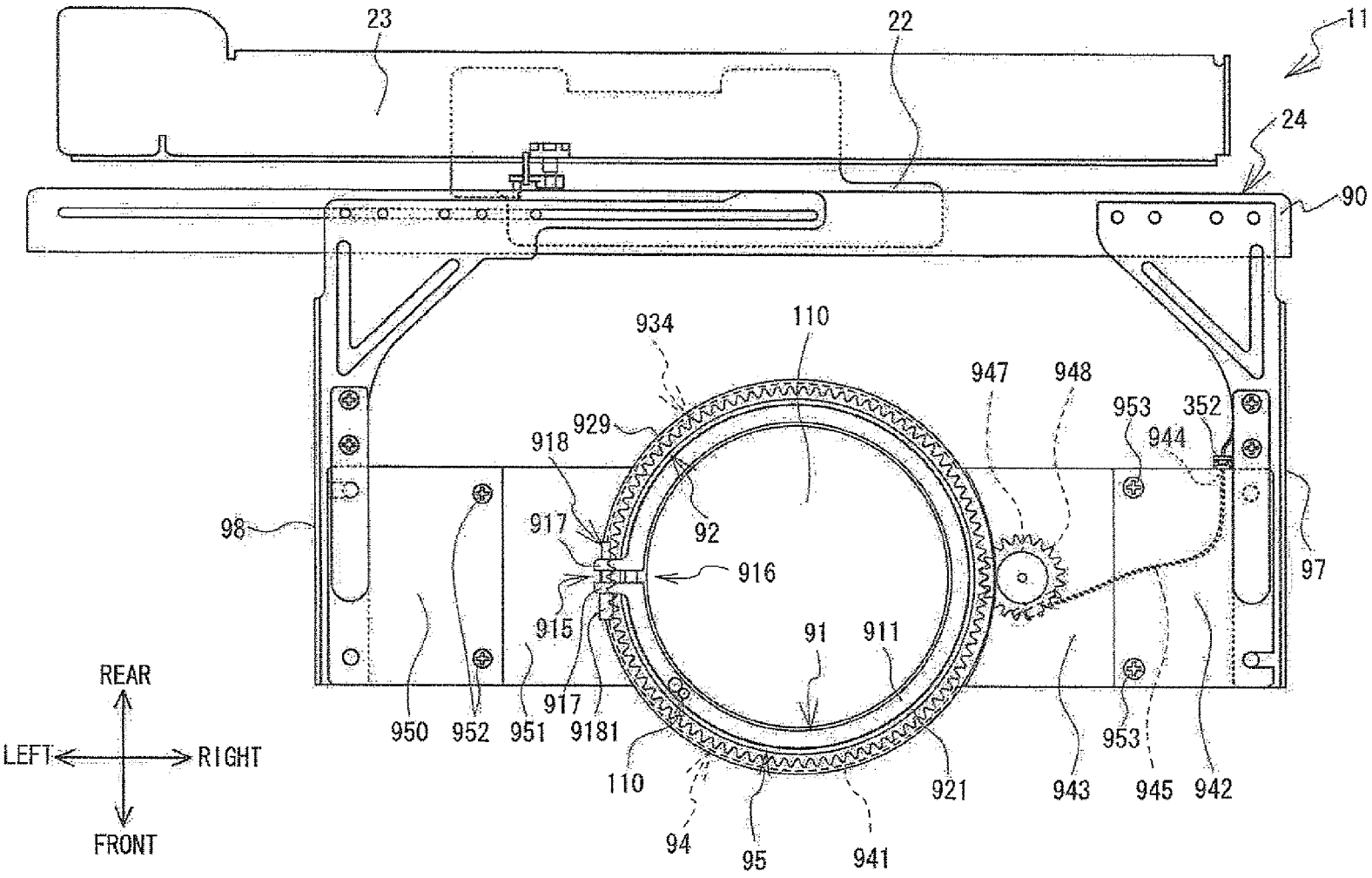
FIG. 18 is a plan view that shows the rotatable embroidery frame being held in the movement mechanism.

Next, a second embodiment will be explained. The second embodiment is an example in which a rotatable embroidery frame 9 is used as the embroidery frame. First, the embroidery frame 9 will be explained with reference to FIGS. 17 and 18. In the explanation that follows, the up-down direction in the FIG. 17 is defined as the up-down direction of an outer frame 94. As shown in FIGS. 17 and 18, the embroidery frame 9 includes an inner frame 91, a middle frame 92, and the outer frame 94, each of which has a circular frame shape. As shown in FIG. 18, the embroidery frame 9 is formed by disposing the middle frame 92 to the outside of the inner frame 91 in the radial direction and by disposing the outer frame 94 to the outside of the middle frame 92 in the radial direction. The embroidery frame 9 is configured to clamp the work cloth 100 between the inner frame 91 and the middle frame 92. The middle frame 92 is configured to be rotatable in relation to the outer frame 94. The inner frame 91 and the middle frame 92 are rotatable in relation to the outer frame 94 around an axis of rotation R shown in FIG. 17. Note that in the embroidery frame 9 of the present embodiment, the rotation axis R passes through the center of each circle formed by each of the inner frame 91, the middle frame 92, and the outer frame 94 (specifically, frame portions 911, 921, 941, which will be described later). Hereinafter, the direction of the rotation axis R is simply referred to as an axial direction.

As shown in FIGS. 17 and 18, the inner frame 91 includes the circular frame portion 911. The frame portion 911 has thicknesses in the axial direction and in the radial direction. The inner frame 91 includes an adjustment portion 915 that is configured to adjust the diameter of the inner frame 91. The diameter of the inner frame can be adjusted according to the thickness of the work cloth 100 that is clamped between the inner frame 91 and the middle frame 92. The adjustment portion 915 includes a parting portion 916, a pair of screw mounting portions 917, and an adjusting screw 918. The parting portion 916 is a location where a portion in the circumferential direction of the frame portion 911 of the inner frame 91 is discontinuous through the axial direction. The pair of the screw mounting portions 917 are provided on upper portions on both sides of the parting portion 916 in the frame portion 911. The pair of the screw mounting portions 917 project to the outside in the radial direction and are positioned opposite one another. The pair of the screw mounting portions 917 have holes 9171, 9172, respectively, that respectively pass through the screw mounting portions 917 in a direction that is orthogonal to the faces of the screw mounting portions 917 that are opposite each other. Of the two holes 9171, 9172, a nut (not shown in the drawings), in which a threaded hole is formed, is embedded in the one hole 9172 (the hole on the lower right side in FIG. 17).

As shown in FIG. 17, the adjusting screw 918 is a screw member that includes a head portion 9181 and a shaft portion 9183. The head portion 9181 is a large-diameter component that the user may rotate by gripping the head portion 9181 with the fingers. The shaft portion 9183 is a small-diameter component that extends as a single piece from the head portion 9181. A male threaded portion 9182 is formed from approximately the center of the axial direction of the shaft portion 9183 to the tip. A narrow groove 9184, into which a retaining ring 9185 is fitted, is formed in the shaft portion 9183 in a location that is close to the head portion 9181. The adjusting screw 918 may be mounted in the pair of the screw mounting portions 917 by passing the shaft portion 9183 through the hole 9171 and screwing the male threaded portion 9182 into the threaded hole in the nut that is embedded in the hole 9172. In this state, the retaining ring 9185 may be fitted into the narrow groove 9184 of the shaft portion 9183. The adjusting screw 918 is thus held such that the adjusting screw 918 can rotate in the screw mounting portion 917 on the side where the hole 9171 is located and cannot move in the axial direction.

In a case where the user grips the head portion 9181 with the fingers and rotates the adjusting screw 918, the screw mounting portion 917 on the side where the hole 9172 is formed moves in the axial direction of the shaft portion 9183, via the nut. The movement direction is determined by the rotation direction of the adjusting screw 918. Thus the adjusting screw 918 can couple together the pair of the screw mounting portions 917 and can perform adjustment to increase or reduce the gap between the pair of the screw mounting portions 917. By adjusting the gap between the pair of the screw mounting portions 917, the diameter of the inner frame 91 can be adjusted in accordance with the thickness of the work cloth 100. For example, by narrowing the gap between pair of the screw mounting portions 917, the diameter of the inner frame 91 becomes smaller. As a result, the embroidery frame 9 can clamp the work cloth 100 having a greater thickness between the middle frame 92 and the inner frame 91. Note that, for ease of explanation, the retaining ring 9185 has been omitted from FIG. 18.

A mark 110 is provided on an upper face of the inner frame 91. As shown in FIGS. 17 and 18, the middle frame 92 includes the circular frame portion 921, which has an inside diameter that is larger than the outside diameter of the frame portion 911 of the inner frame 91. The middle frame 92 can be removably attached to the inner frame 91 by removably attaching the frame portion 921 of the middle frame 92 on the outer side of the frame portion 911 of the inner frame 91 in the radial direction. A large gear 934 is formed on the outer circumferential side face of the lower portion of the frame portion 921 of the middle frame 92 and is a gear that is formed around the entire circumference of the frame portion 921. The large gear 934 can mesh with a small gear 948 (described later; refer to FIG. 18).

As shown in FIG. 17, a flange portion 929 that projects to the outside in the radial direction around the entire circumference of the frame portion 921 is provided in a central portion in the axial direction of the outer circumferential side face of the frame portion 921, on the upper side of the large gear 934. A support portion 936 that projects to the inside in the radial direction around the entire circumference of the frame portion 921 is provided on the inner circumferential side face of the lower end of the frame portion 921. The support portion 936 is a component that supports a lower end face of the inner frame 91.

As shown in FIGS. 17 and 18, the outer frame 94 includes the circular frame portion 941. A support portion 946 that projects to the inside in the radial direction around the entire circumference of the frame portion 941 is provided on the inner circumferential side face of the lower edge of the frame portion 941 (refer to FIG. 17). The support portion 946 supports a lower end surface of the middle frame 92 and thus the frame portion 941 supports the middle frame 92.

An attachment portion 942 and an attachment portion 950 are provided on the outer side of the frame portion 941 in the radial direction. The attachment portion 942 is configured to be detachably mounted on the right arm portion 97 of the movement mechanism 11. The attachment portion 950 is configured to be detachably mounted on the left arm portion 98 of the movement mechanism 11. A plate 951 that extends from the frame portion 941 to the attachment portion 950 is provided between the frame portion 941 and the attachment portion 950. The plate 951 and the attachment portion 950 are joined by screws 952.

A box-shaped housing portion 943 that joins the frame portion 941 and the attachment portion 942 is provided between the frame portion 941 and the attachment portion 942. The housing portion 943 includes a projecting portion 954 that projects toward the outside in the radial direction of the frame portion 941 at the bottom end on the side of the attachment portion 942 of the housing portion 943. The attachment portion 942 is disposed on the upper surface of the projecting portion 954, and the attachment portion 942 and the housing portion 943 are joined by screws 953.

A frame-side connector 944 is provided on one end (the end portion on the lower right side in FIG. 17) of the projecting portion 954. The frame-side connector 944 is a convex connector. As shown in FIG. 18, a sewing machine-side connector 352, which is a concave connector to which the frame-side connector 944 can be coupled, is provided on the right arm portion 97 of the movement mechanism 11 of the sewing machine 1. When the embroidery frame 9 is attached to the right arm portion 97 and the left arm portion 98 of the movement mechanism 11, the frame-side connector 944 is coupled and electrically connected to the sewing machine-side connector 352. The frame-side connector 944 is electrically connected to a motor 947 through a conductor wire 945. The sewing machine-side connector 352 is connected to the CPU 61 through the I/O 66 (refer to FIG. 5) and a drive circuit (not shown in the drawings) that drives the motor 947. When the frame-side connector 944 is connected to the sewing machine-side connector 352, the CPU 61 can control the motor 947.

As shown in FIG. 18, the motor 947 is disposed in the housing portion 943. The motor 947 is disposed in the housing portion 943 such that a rotating shaft of the motor 947 faces downward. The small gear 948, which has a diameter that is smaller than that of the large gear 934 of the middle frame 92, is fixed to the lower end of the rotating shaft of the motor 947. The small gear 948 meshes with the large gear 934. When the motor 947 is driven and the small gear 948 is rotated, the large gear 934 rotates. The middle frame 92 thus rotates in relation to the outer frame 94.

A mode in which the inner frame 91, the middle frame 92, and the outer frame 94 are combined, and a mode in which the embroidery frame 9 is attached to the sewing machine 1 (the movement mechanism 11) will be explained. For example, the user may place the middle frame 92 on a work bench (not shown in the drawings) such that the large gear 934 is on the lower side. Then the user may place the work cloth 100 on the middle frame 92. The user may insert the inner frame 91 into the inner side of the middle frame 92 while pressing the work cloth 100 downward with the bottom end of the inner frame 91. The work cloth 100 may be thus clamped between the inner frame 91 and the middle frame 92. At this time, the user may rotate the adjusting screw 918 as appropriate and adjust the diameter of the inner frame 91 in accordance with the thickness of the work cloth 100. The face of the work cloth 100 on which the sewing will be performed may enter a state of being stretched taut on the inner side of the inner frame 91 at the bottom end of the inner frame 91. In the explanation that follows, the frame that is formed by combining of the inner frame 91 and the middle frame 92 is referred to as an assembled unit 95 (refer to FIG. 18).

Next, the user may place the assembled unit 95 into the outer frame 94 from the top side of the outer frame 94. At this time, the user may place the assembled unit 95 in the frame portion 941 such that the large gear 934 and the small gear 948 mesh with each other. Thus the large gear 934 and the small gear 948 may be meshed with each other, and the middle frame 92 (the assembled unit 95) may be locked with the outer frame 94. The inner frame 91, the middle frame 92, and the outer frame 94 can be thus combined to produce the completed form of the embroidery frame 9.

The user may attach the completed form of the embroidery frame 9 to the sewing machine 1 by attaching the attachment portions 942, 950 of the embroidery frame 9 to the right arm portion 97 and the left arm portion 98 of the movement mechanism 11. In the process, the sewing machine-side connector 352 that is provided in the right arm portion 97 and the frame-side connector 944 that is provided in the attachment portion 942 are connected electrically (refer to FIG. 18). Thus the CPU 61 can control the drive circuits and control the motor 947 through the sewing machine-side connector 352, the frame-side connector 944, and the conductor wire 945. By controlling the motor 947, the CPU 61 can rotate and lock the middle frame 92 (the assembled unit 95) in relation to the outer frame 94.

A cutting blade data table 48 shown in FIG. 19 will be explained. The cut lengths that can be formed in the work cloth 100 by the cutting blades 52 (531 to 533) that, among the needle bars 71 to 78, are attached to the needle bars 71 to 73 are registered in the cutting blade data table 48. The registered cut lengths are values that the user has input by panel operations. In the second embodiment, the cutting blade 531, with a cut length of 1.5 millimeters, is attached to the needle bar 71 of the sewing machine 1. The cutting blade 532, with a cut length of 3 millimeters, is attached to the needle bar 72. The cutting blade 533, with a cut length of 4.5 millimeters, is attached to the needle bar 73. The cutting blades 52 are not attached to the needle bars 74 to 78. As shown in FIG. 19, in the cutting blade data table 48, the cut lengths of 1.5 millimeters, 3 millimeters, and 4.5 millimeters are associated with the needle bars 71 to 73, respectively. In FIG. 19, a "–" indicates that data have not been registered in the cutting blade data table 48. Note that the cut angles for the cutting blades 531 to 533 described above are all zero degrees.

Figure 20:
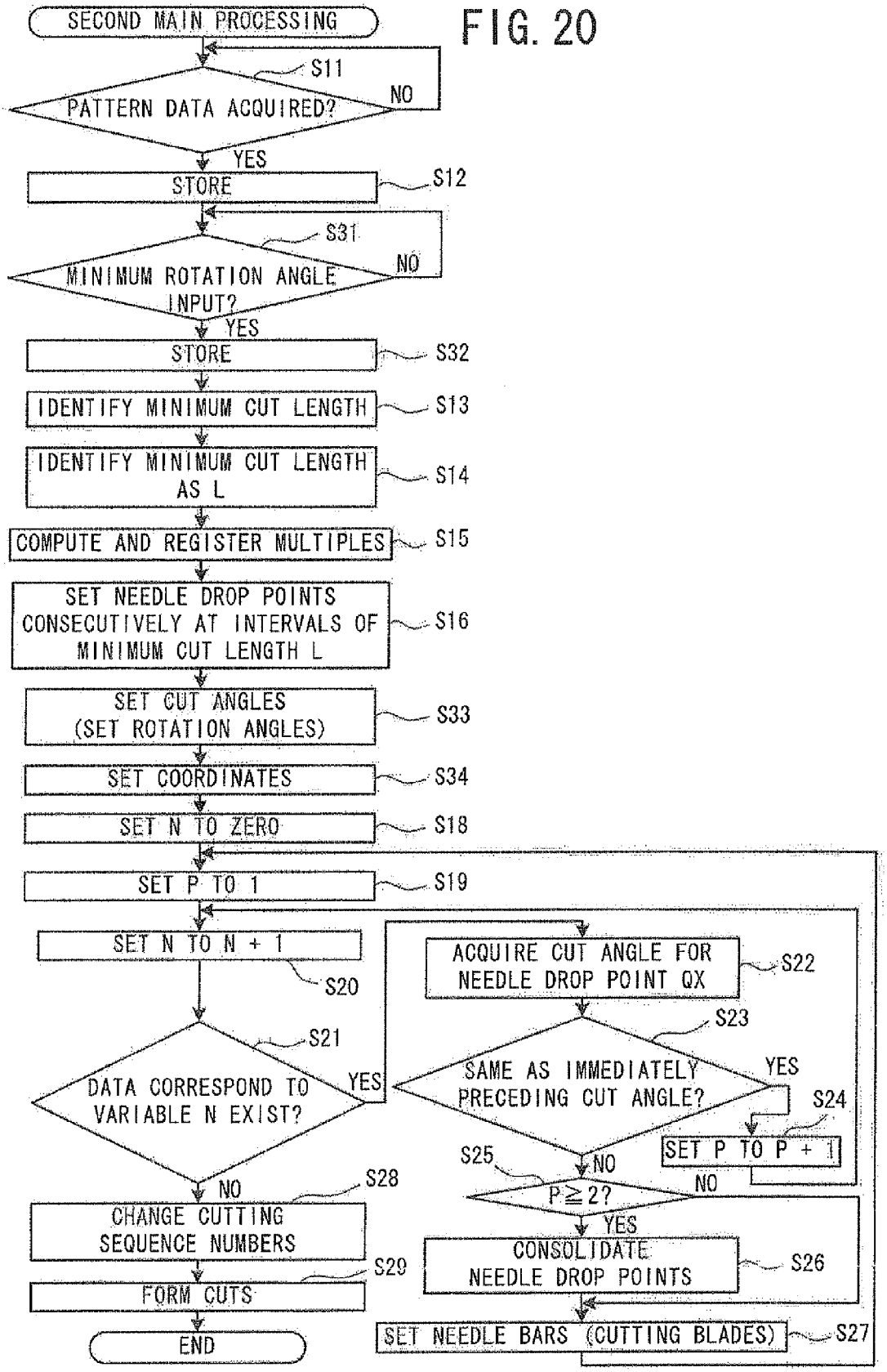
FIG. 20 is a flowchart of second main processing.

Second main processing in the second embodiment will be explained with reference to FIG. 20. In the second main processing, processing steps that are the same as in the first main processing in the first embodiment are indicated by the same step numbers, and detailed explanations will be omitted. In the second main processing, in the same manner as in the first main processing, the CPU 61 determines whether the pattern data have been acquired (Step S11). In a case where the pattern data have been acquired (YES at Step S11), the CPU 61 stores the acquired pattern data in the RAM 63 (Step S12). In the explanation that follows, the example in which the pattern data for the pattern line 101 shown in FIG. 7 are acquired will be used, in the same manner as in the first embodiment.

The CPU 61 determines whether a minimum rotation angle has been input (Step S31). The minimum rotation angle is input by the user through a panel operation, for example. The minimum rotation angle is the smallest rotation angle by which the embroidery frame 9 can rotate. In the present embodiment, the sewing machine 1 can control the rotation of the embroidery frame 9 as desired by using the motor 947. Therefore, the minimum rotation angle is 1 degree. Note that, for example, in a case where a rotation angle of 45 degrees is input by the user as the minimum rotation angle, the minimum rotation angle is 45 degrees.

In a case where the minimum rotation angle has not been input (NO at Step S31), the CPU 61 repeats the processing at Step S31. In a case where the minimum rotation angle has been input (YES at Step S31), the CPU 61 stores the acquired minimum rotation angle in the RAM 63 (Step S32). In the present embodiment, an example is used in which 1 degree has been input as the minimum rotation angle.

The CPU 61 identifies the minimum cut length in the same manner as in the first embodiment (Step S13). The CPU 61 identifies the identified minimum cut length as the cut length L and stores the identified cut length L in the cutting blade data table 48 (Step S14). The cut lengths that are associated with the needle bars 7 in the cutting blade data table 48 are computed as multiples of the minimum cut length L. Based on the computed multiples, the CPU 61 stores the cut lengths that are different from the minimum cut length L in the cutting blade data table 48 (Step S15). In this manner, the cut lengths L, 2L, 3L are respectively associated with the needle bars 71, 72, 73, as shown in FIG. 21.

The CPU 61 sets the needle drop points consecutively at the predetermined intervals (the minimum cut length L) along the pattern line 101 (Step S16). Thus the needle drop points QX (X=1, 2, 3 . . . 73) shown in FIG. 9 are set. In the second embodiment, the coordinates of the set needle drop points Q1 to Q73 are registered in a cut data table 49 (refer to FIG. 22) and stored in the RAM 63.

The CPU 61 sets the cut angle for each of the needle drop points QX that were set by the processing at Step S16 (Step S33). In the processing at Step S33, the rotation angle that is the closest to the direction in which the pattern line 101 extends at the needle drop point QX is selected from among the rotation angles to which the embroidery frame 9 can be rotated and set as the cut angle. In other words, the rotation angle of the embroidery frame 9 is set. Specifically, first, as shown in FIG. 11, the line segments 111, 112, 113 are defined that connect two adjacent needle drop points QX (Q4 to Q5, Q5 to Q6, and Q6 to Q7). In the present embodiment, the minimum rotation angle that was stored by the processing at Step S32 is 1 degree. Therefore, the embroidery frame 9 can be rotated by 1 degree at a time. For example, in a case where the direction in which the line segment 111 extends is 88 degrees, the cut angles for the needle drop points Q4, Q5 positioned at both ends of the line segment 111 are each set to 88 degrees. In the same manner, in a case where the direction in which the line segment 112 extends is 75 degrees, the cut angles for the needle drop points Q5, Q6 positioned at both ends of the line segment 112 are each set to 75 degrees. In a case where the direction in which the line segment 113 extends is 62 degrees, the cut angles for the needle drop points Q6, Q7 positioned at both ends of the line segment 113 are each set to 62 degrees. The cut angles are set in the same manner for all of the other needle drop points QX. The cut angles that have been set are registered in the cut data table 49, as shown in FIG. 23. Note that in a case where the minimum rotation angle is 5 degrees and the direction in which a line segment extends in 13 degrees, for example, the cut angles for the needle drop points QX positioned at both ends of the line segment may be set to 15 degrees, which is the closest possible rotation angle to 13 degrees.

The CPU 61 sets (adjusts) the positions (the coordinates) of the needle drop points QX to match the cut angles (the rotation angles) (Step S34). The coordinates of the needle drop points QX were set by the processing at Step S16 (refer to FIG. 23) without taking into account the fact that the embroidery frame 9 (the assembled unit 95) may be rotated. Therefore, in a case where the embroidery frame 9 is rotated, the coordinates of the needle drop points QX in the cut data table 49 and the actual positions of the needle drop points QX may be different. Therefore, at Step S34, the post-rotation coordinates of the needle drop points QX are set. The coordinates of the needle drop points QX in the cut data table 49 shown in FIG. 23 are adjusted as shown in FIG. 24 by the processing at Step S34. For example, as shown in FIG. 23, the cut angle (the rotation angle) for the needle drop point Q17 (X17, Y17) is 45 degrees. Therefore, the coordinates for the needle drop point Q17 are set to (X17 cos 45°−Y17 sin 45°, X17 sin 45°+Y17 cos 45°), as shown in FIG. 24. Note that in a case where two cut angles are associated with one needle drop point, as 90 degrees and zero degrees are associated with the needle drop point Q1, the coordinates of the needle drop point Q1 are set separately for each of the two cut angles (refer to FIG. 24).

The CPU 61 performs the processing at Steps S18 to S27 in the same manner as in the first embodiment. In the processing at Step S26, at least a part of the consecutive needle drop points QX for which the cut angles are the same are consolidated into the single needle drop point QX', based on the cut lengths that are registered in the cutting blade data table 48. For example, in the cut data table 49 (refer to FIG. 24), the cut angle 45 degrees is acquired for each of the needle drop points Q17 to Q28 (Step S22). Next, the cutting blade data table 48 is referenced, and from among the cut lengths that are associated with the acquired cut angle of 45 degrees, the cut length 3L is identified as the cut length for which the multiple is closest to the variable P while not exceeding the value of the variable P. The needle drop points Q17 to Q28 are set consecutively at intervals of the minimum cut length L. Therefore, the CPU 61 consolidates three of the consecutive needle drop points QX that are associated with the cut length L into the single needle drop point QX' with the cut length 3L. That is, the CPU 61 computes the intermediate point among the three needle drop points QX and then consolidates the three needle drop points QX into the one needle drop point QX' at the computed intermediate point. The intermediate point among the three needle drop points QX is specifically the intermediate point between the needle drop point QX with the lowest number QX among the three needle drop points QX and the needle drop point QX with the highest number QX.

For example, in the case of the needle drop points Q17 to Q19, the coordinates for the needle drop point Q17 are (X17 cos 45°−Y17 sin 45°, X17 sin 45°+Y17 cos 45°), and the coordinates for the needle drop point Q19 are (X19 cos 45°−Y19 sin 45°), X19 sin 45°+Y19 cos 45°). A needle drop point Q17' is computed as the intermediate point among the needle drop points Q17 to Q19. Accordingly, the three needle drop points Q17 to Q19 shown in FIG. 24 are consolidated into the needle drop point Q17', as shown in FIG. 25. For the needle drop point Q17', the X coordinate is {(X17+X19)cos 45°−(Y17+Y19)sin 45°}/2, and the Y coordinate is {(X17+X19) sin 45°+(Y17+Y19)cos 45°}/2. Note that, for example, in a case where two consecutive needle drop points QX with the same cut angle remain after three of the needle drop points QX have been consolidated into a single needle drop point QX', the intermediate point between those remaining two needle drop points QX is computed. Based on the cut length 2L, the two adjacent needle drop points QX are consolidated into a needle drop point QX' at the computed intermediate point. The cutting sequence number is changed in the order of the X values of the needle drop points QX and QX'. The other needle drop points QX are also consolidated into the needle drop points QX' in the same manner.

Figure 26:
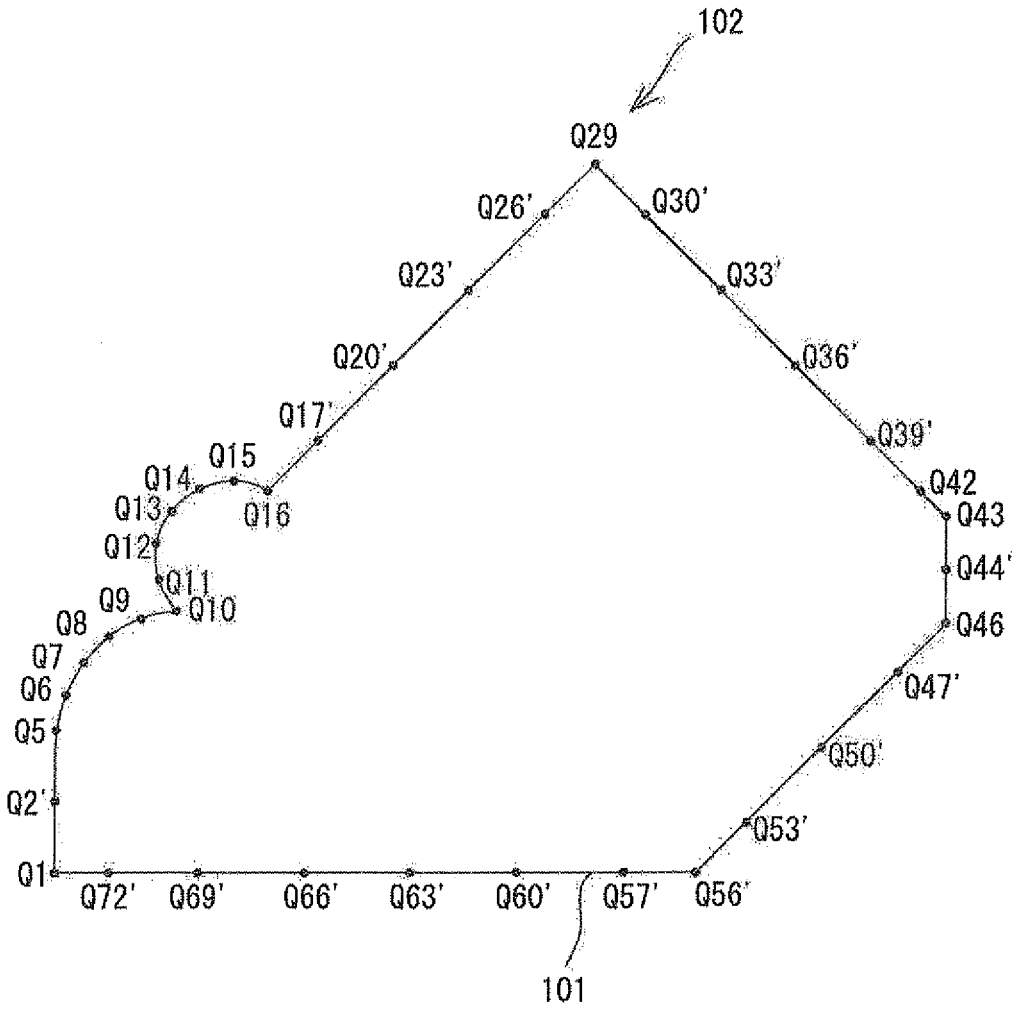
FIG. 26 is an explanatory figure of the needle drop points on the pattern line after some of the needle drop points have been consolidated.

FIG. 26 is a figure that shows the needle drop points QX' that have been consolidated by the processing at Step S26, as well as the unconsolidated needle drop points QX, on the pattern line 101. As shown in FIG. 26, the groups of three consecutive needle drop points QX and two consecutive needle drop points QX for which the cut angles are the same are each consolidated into the single needle drop points QX'. Therefore, the total number of the needle drop points QX and the needle drop points QX' is less than the number of the needle drop points before the processing at Step S26 was performed (refer to FIG. 9). Note that in FIG. 26, the needle drop point Q44' and the needle drop point Q72' are needle drop points into each of which two of the needle drop points QX have been consolidated.

In the processing at Step S27, for each of the needle drop points QX' that were consolidated and at the needle drop points QX that were not consolidated by the processing at Step S26, one of the needle bars 7 to which one of the cutting blades 52 is attached is set from among the plurality of needle bars 71 to 78 and is registered in the cut data table 47. For example, the needle drop point Q17', which was consolidated (the position (coordinates) was changed) by the processing at Step S26, is the needle drop point QX' into which the three needle drop points Q17 to Q19 were consolidated. That is, the three needle drop points corresponding to a cut length 3L as a whole was consolidated into the single needle drop point Q17'. Accordingly, the cutting blade data table 48 (refer to FIG. 21) is referenced, and the needle bar 73, to which the cutting blade 533 with the cut length 3L is attached, is set for the needle drop point Q17'. Then the needle bar 73 is registered in the cut data table 49 in association with the needle drop point Q17', as shown in FIG. 27. Note that each of the needle drop point Q44' and the needle drop point Q72' is the needle drop point QX' into which two of the needle drop points QX were consolidated, although this is not shown in the drawings. Therefore, the needle bar 72, to which the cutting blade 532 with the cut length 2L is attached, is registered in association with the needle drop point Q44' and the needle drop point Q72'.

When the CPU 61 has performed the processing at Steps S22 to S27 for all of the needle drop points QX, the CPU 61 determines that the data do not exist for the cutting sequence number that corresponds to the variable N (NO at Step S21) and, in the same manner as in the first embodiment, changes the cutting order for the needle drop points QX and the needle drop points QX' such that the same cutting blade 52 is to be used consecutively when the sewing machine 1 is operated (Step S28). The cut data table 49 after the cutting order changed is omitted from the drawings. In the same manner as in the first embodiment, the CPU 61 causes the sewing machine 1 to perform the forming of the cuts along the pattern line 101 in accordance with the cutting order in the cut data table 49 (Step S29). In the second embodiment, the motor 947 is controlled, and the embroidery frame 9 (the assembled unit 95) is rotated to the cut angle (the rotation angle). The movement mechanism 11 is driven, and the embroidery frame 9 is moved such that the needle bar 7 (the cutting blade 52) is positioned directly above the position indicated by the coordinates of the needle drop point QX or QX'. Then, the work cloth 100 is pierced by the cutting blade 52 at the needle drop point QX or QX', and the cut is formed in the work cloth 100. In a case where the operating of the needle bar 7 that corresponds to the last cutting sequence number has been finished, the CPU 61 terminates the second main processing.

The processing in the second embodiment is performed as described above. In the present embodiment, the same effects as those achieved in the first embodiment can be produced using the rotatable embroidery frame 9.

Note that the present disclosure is not limited to the embodiments that are described above, and various types of modifications can be made. For example, the cut data may be generated by an external device instead of by the sewing machine 1. For example, a device such as a portable terminal, a personal computer, or the like, may be used as the external device. A CPU that is provided in the device may perform the processing that generates the cut data tables 47, 49 in the first main processing and the second main processing. In that case, the device may, for example, transmit the generated cut data tables 47, 49 to the sewing machine 1, and the sewing machine 1 may perform the sewing.

It is also acceptable, for example, for the cut length not to be the same as the cutting edge width of the cutting blade 52. For example, the user may attach a blade that has a V-shaped cutting edge to a tip of the needle bar. The sewing machine 1 may then cause the needle bar to move up and down such that the work cloth 100 is pierced up to the midpoint of the blade. In that case, the cut length that is formed in the work cloth 100 is shorter than the cutting edge width. The needle bar may also be structured such that the mounting position (the mounting height) of the cutting blade can be changed. In that case, the user can change the amount by which the cutting blade pierces the work cloth 100. Therefore, the user can change the cut length, as desired.

It is also not necessary for the cutting order for the needle drop points QX and the needle drop points QX' to be changed such that the same cutting blade 52 is consecutively used. For example, the sewing machine 1 may also form the cuts in the work cloth 100 using the cut data tables 47, 49 that are generated by the processing at Step S27, without performing any processing that is equivalent to the processing at Step S28.

The embroidery frame 9 (the assembled unit 95) in the second embodiment is configured to be rotated by the rotation of the motor 947. However, same sort of processing as the second main processing may be performed with an embroidery frame that is rotated by hand of the user, for example. In that case, in a case where the CPU 61 of the sewing machine 1 performs the cutting processing in the processing at Step S29 of the second main processing (refer to FIG. 20), the angle to which the embroidery frame to be rotated may be displayed on the liquid crystal display 15, prompting the user to perform the rotation operation. The sewing machine 1 may also be provided with a camera. The sewing machine 1 may use the camera to capture an image of the mark 110, then detect the rotation angle of the embroidery frame 9 based on the position of the mark 110 in the captured image. Based on the detected rotation angle, the sewing machine 1 may then display the current rotation angle and the target rotation angle on the liquid crystal display 15, thus prompting the user to perform the rotation operation for the embroidery frame 9.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus, comprising:

a processor; and a memory configured to store a plurality of cut length data items and computer-readable instructions, wherein the plurality of cut length data items indicate lengths of a plurality of cuts configured to be formed by a plurality of cutting blades, each of the plurality of cutting blades is configured to be attachable to one of a plurality of needle bars of a sewing machine, and the computer-readable instructions instruct the apparatus to execute steps comprising:

acquiring pattern data, wherein the pattern data represent a position of a point on a pattern line and the pattern line indicates a shape of a pattern to be cut along the pattern line;

setting, as a plurality of first cutting needle drop points, a plurality of points on the pattern line at predetermined intervals, wherein each of the plurality of first cutting needle drop points is a position at which one of the plurality of cutting blades is to be inserted;

setting a cut angle corresponding to each of the plurality of first cutting needle drop points, wherein the cut angle is an angle that is determined based on a direction in which the pattern line extends at a position of each of the plurality of first cutting needle drop points;

determining a plurality of second cutting needle drop points among the plurality of first cutting needle drop points, wherein the second cutting needle drop points are arranged consecutively along the pattern line, and the cut angles of the plurality of the second cutting needle drop points are same;

consolidating, based on the plurality of cut length data items, at least some of the plurality of second cutting needle drop points into at least one third cutting needle drop point;

identifying a cutting blade corresponding to each of a plurality of fourth cutting needle drop points among the plurality of cutting blades based on the plurality of cut length data items, wherein the plurality of fourth cutting needle drop points include at least one first cutting needle drop point which is unconsolidated among the plurality of first cutting needle drop points and at least one third cutting needle drop point which is consolidated; and generating cut data for the sewing machine, wherein the cut data are configured to cause the sewing machine to sequentially insert the identified cutting blades at the plurality of fourth cutting needle drop points along the pattern line.

2. The apparatus according to claim 1, wherein each of the predetermined intervals is the same length as one of the plurality of cut lengths indicated by the plurality of cut length data items.

3. The apparatus according to claim 1, wherein the plurality of cut lengths indicated by the plurality of cut length data items correspond to a plurality of cutting edge widths of the plurality of cutting blades.

4. The apparatus according to claim 3, wherein each of the plurality of cut lengths is a cut length that is an integer multiple of a minimum cut length, wherein the minimum cut length is the shortest cut length among the plurality of cut lengths; and each of the predetermined intervals is the same length as the minimum cut length.

5. The apparatus according to claim 1, wherein the plurality of needle bars are configured to receive the plurality of cutting blades, wherein the directions of cutting edges of the plurality of cutting blades are different from one another, the memory is further configured to store a plurality of cut direction data items, wherein the plurality of cut direction data items indicate a plurality of different directions for the cuts configured to be formed in a work cloth by the plurality of cutting blades, and the setting the cut angle includes setting, among the plurality of cut directions indicated by the plurality of cut direction data items, one of the cut direction that is the closest to the direction in which the pattern line extends at the position of each of the plurality of first cutting needle drop points as the cut angle.

6. The apparatus according to claim 1, wherein the sewing machine is configured to receive an embroidery frame, wherein the embroidery frame is configured to hold a work cloth and to be rotatable in relation to the plurality of needle bars, and the setting the cut angle includes setting, among a plurality of angles to which the embroidery frame is rotatable, an angle that is the closest to the direction in which the pattern line extends at the position of each of the plurality of first cutting needle drop points as the cut angle.

7. The apparatus according to claim 1, wherein the generating the cut data includes rearranging an order of the plurality of fourth cutting needle drop points, based on the identified cutting blade for each of the plurality of fourth cutting needle drop points, wherein the plurality of fourth cutting needle drop points corresponding to the same identified cutting blades are arranged in consecutive order, and generating the cut data configured to cause the sewing machine to sequentially insert the identified cutting blades at the rearranged plurality of fourth cutting needle drop points.

8. The apparatus according to claim 1, wherein the memory is further configured to store a plurality of needle bar data items, wherein the plurality of needle bar data items indicate the plurality of cutting blades that are configured to be attachable to the plurality of needle bars, and the identifying the cutting blade includes identifying, based on the plurality of cut length data items and the plurality of needle bar data items, one of the plurality of needle bars that is configured to receive the identified cutting blade corresponding to each of the plurality of fourth cutting needle drop points.

9. A non-transitory computer-readable medium storing computer-readable instructions that instruct an apparatus to execute steps comprising:

acquiring pattern data, wherein the pattern data represent a position of a point on a pattern line and the pattern line indicates a shape of a pattern to be cut along the pattern line;

setting, as a plurality of first cutting needle drop points, a plurality of points on the pattern line at predetermined intervals, wherein each of the plurality of first cutting needle drop points is a position at which one of a plurality of cutting blades is to be inserted;

setting a cut angle corresponding to each of the plurality of first cutting needle drop points, wherein the cut angle is an angle that is determined based on a direction in which the pattern line extends at a position of each of the plurality of first cutting needle drop points;

determining a plurality of second cutting needle drop points among the plurality of first cutting needle drop points, wherein the second cutting needle drop points are arranged consecutively along the pattern line, and the cut angles of the plurality of the second cutting needle drop points are same;

consolidating, based on a plurality of cut length data items, at least some of the plurality of second cutting needle drop points into at least one third cutting needle drop point, wherein the plurality of cut length data items indicate lengths of a plurality of cuts configured to be formed by the plurality of cutting blades;

identifying a cutting blade corresponding to each of a plurality of fourth cutting needle drop points among the plurality of cutting blades based on the plurality of cut length data items, wherein the plurality of fourth cutting needle drop points include at least one first cutting needle drop point which is unconsolidated among the plurality of first cutting needle drop points and at least one third cutting needle drop point which is consolidated; and generating cut data for the sewing machine, wherein the cut data are configured to cause the sewing machine to sequentially insert the identified cutting blades at the plurality of fourth cutting needle drop points along the pattern line.

10. The non-transitory computer-readable medium according to claim 9, wherein each of the predetermined intervals is the same length as one of the plurality of cut lengths indicated by the plurality of cut length data items.

11. The non-transitory computer-readable medium according to claim 9, wherein each of the plurality of cut lengths indicated by the plurality of cut length data items is the same length as a cutting edge width of one of the plurality of cutting blades.

12. The non-transitory computer-readable medium according to claim 11, wherein each of the plurality of cut lengths is a cut length that is an integer multiple of a minimum cut length, wherein the minimum cut length is the shortest cut length among the plurality of cut lengths; and each of the predetermined intervals is the same length as the minimum cut length.

13. The non-transitory computer-readable medium according to claim 9, wherein the plurality of needle bars are configured to receive the plurality of cutting blades, wherein the directions of cutting edges of the plurality of cutting blades are different from one another, the setting the cut angle includes setting, among the plurality of cut directions indicated by a plurality of cut direction data items, one of the cut direction that is the closest to the direction in which the pattern line extends at the position of each of the plurality of first cutting needle drop points as the cut angle, wherein the plurality of cut direction data items indicate a plurality of different directions for the cuts configured to be formed in a work cloth by the plurality of cutting blades.

14. The non-transitory computer-readable medium according to claim 9, wherein the sewing machine is configured to receive an embroidery frame, wherein the embroidery frame is configured to hold a work cloth and to be rotatable in relation to the plurality of needle bars, and the setting the cut angle includes setting, among a plurality of angles to which the embroidery frame is rotatable, an angle that is the closest to the direction in which the pattern line extends at the position of each of the plurality of first cutting needle drop points as the cut angle.

15. The non-transitory computer-readable medium according to claim 9, wherein the generating the cut data includes rearranging an order of the plurality of fourth cutting needle drop points, based on the identified cutting blade for each of the plurality of fourth cutting needle drop points, wherein the plurality of fourth cutting needle drop points corresponding to the same identified cutting blade are arranged in consecutive order, and generating the cut data configured to cause the sewing machine to sequentially insert the identified cutting blades at the rearranged plurality of fourth cutting needle drop points.

16. The non-transitory computer-readable medium according to claim 9, wherein the identifying the cutting blade includes identifying, based on the plurality of cut length data items and a plurality of needle bar data items, one of the plurality of needle bars that is configured to receive the identified cutting blade corresponding to each of the plurality of fourth cutting needle drop points, wherein the plurality of needle bar data items indicate the plurality of cutting blades that are configured to be attachable to the plurality of needle bars.

17. The apparatus according to claim 1, wherein the apparatus is a multi-needle sewing machine includes the plurality of needle bars, the computer-readable instructions further instruct the multi-needle sewing machine to execute steps comprising:

generating a signal based on the cut data, wherein the multi-needle sewing machine is configured to insert the identified cutting blade at each of the plurality of fourth cutting needle drop points along the pattern line based on the generated signal.

* * * * *